US006485126B1

(12) United States Patent
Kato et al.

(10) Patent No.: US 6,485,126 B1
(45) Date of Patent: Nov. 26, 2002

(54) INK JET HEAD AND METHOD OF PRODUCING THE SAME

(75) Inventors: Seiichi Kato; Kouichi Ohtaka, both of Miyagi; Makoto Tanaka; Eiji Mochizuki, both of Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/632,046

(22) Filed: Aug. 3, 2000

(30) Foreign Application Priority Data

Aug. 5, 1999 (JP) ..... 11-222444

(51) Int. Cl.[7] ..... B41J 2/04
(52) U.S. Cl. ..... 347/54
(58) Field of Search ..... 347/54, 68, 69, 347/70, 71, 72, 50, 40; 399/261; 361/700; 29/890.1; 310/328–330

(56) References Cited

U.S. PATENT DOCUMENTS 5,734,395 A * 3/1998 Kamisuki et al. ..... 347/54

FOREIGN PATENT DOCUMENTS

| | | |
|---|---|---|
| JP | 61-59911 | 3/1986 |
| JP | 6-71882 | 3/1994 |
| JP | 9307218 | 11/1997 |

* cited by examiner

*Primary Examiner*—Raquel Yvette Gordon
(74) *Attorney, Agent, or Firm*—Cooper & Dunham LLP

(57) ABSTRACT

An ink jet head that can be easily connected to an external circuit is provided without an increase in the number of production procedures. Diaphragms and a diaphragm external electrode having the same thickness as the diaphragms are formed on a silicon substrate that is a first substrate located on the same plane as the diaphragms. The diaphragm external electrode is located within 2 $\mu$m from the individual external electrodes of a plurality of electrodes on a second substrate.

25 Claims, 27 Drawing Sheets

INK JET HEAD AND METHOD OF PRODUCING THE SAME

BACKGROUND OF THE INVENTION

1. Field of the Invention

The present invention relates to an ink jet head, and, more particularly, to an ink jet head utilizing electrostatic force and a method of producing such an ink jet head.

2. Description of the Related Art

An ink jet head installed in an ink jet recording apparatus used as an image recording apparatus, such as a printer, facsimile machine, copying machine, or plotter, comprises nozzle holes to discharge ink droplets, discharging chambers (also referred to as pressurized chambers, pressurized liquid chambers, liquid chambers, or ink passages) communicating with the nozzle holes, and an energy generating unit for generating energy to pressure the ink in the discharging chambers. By driving the energy generating unit, the ink in the discharging chambers are pressurized, so that ink droplets are discharged through the nozzle holes. Normally, such an ink jet head is of an ink-on-demand type that discharges ink droplets only when ink is required for recording.

Japanese Laid-Open Patent Application No. 2-51734 discloses an ink jet head in which piezoelectric elements are employed as the energy generating unit for generating the energy to pressurize the ink in the discharging chambers. The diaphragms that forms the wall surfaces of the discharging chambers are deformed by the piezoelectric elements to change the content volume of the discharging chambers, thereby discharging ink droplets. Japanese Laid-Open Patent Application No. 61-59911 discloses an ink jet head in which a heat generating resistor is employed to heat the ink to form bubbles in the discharging chamber. The bubbles pressurize the ink so that ink droplets are discharged.

In the former ink jet head using the piezoelectric elements, however, the process of bonding piezoelectric chips to the diaphragms to give pressure to the discharging chambers is very complicated. Since an ink jet recording apparatus is required to perform a high-quality operation at high speed, it is necessary to employ a plurality of high-concentration nozzles in the ink jet head. However, the process of producing minute piezoelectric elements and the process of bonding a number of piezoelectric elements are very complicated and time-consuming. Furthermore, it is necessary to produce the piezoelectric elements in a thickness of approximately 30 to 150 $\mu$m. However, with the conventional machine accuracy in size and shape, it is difficult to obtain uniform printing quality.

Also, in the latter ink jet head using the heat generating resistor, there is a problem that the heat generating resistor is damaged by the repetitive rapid heating and cooling, and by the shock at a time of bubble bursting. As a result, the life of the ink jet head becomes shortened.

To eliminate the above problems, Japanese Laid-Open Patent Application No. 6-71882 suggests an ink jet head in which the diaphragms that form the wall surfaces of the discharging chambers are deformed by electrostatic force so as to change the content volume of the discharging chambers, thereby discharging ink droplets. This ink jet head utilizing electrostatic force is advantageous in being small in size, having high density and high printing quality, and lasting for a long period of time.

In the ink jet head utilizing electrostatic force, it is necessary to apply an electric voltage from an external circuit to the diaphragms and the electrodes adjacent to the diaphragms so as to deform the diaphragms by electrostatic force.

Japanese Laid-Open Patent Application No. 9-307218 discloses an ink jet head in which a first substrate that forms diaphragms and liquid chambers and a second substrate that forms electrodes are bonded to each other. An external electrode for diaphragms (a diaphragm external electrode) is disposed on the upper surface of the first substrate, and external electrodes for electrodes (individual external electrodes) are formed in concave portions of the second substrate. Here, a vertical-direction distance between the diaphragm external electrode and the individual external electrodes are equivalent to the thickness of the first substrate. Therefore, a method in which a special-purpose FPC (Flexible Printed Circuit) cable having a top portion branched into two ends is used to have connection with an external circuit has been suggested.

However, having to connect the diaphragm external electrode to the individual external electrodes by the special-purpose FPC cable with the two branched top ends makes the connecting process troublesome and time-consuming. Also, the FPC cable is costly, and the production costs of the ink jet head are increased accordingly.

If the diaphragms and the electrodes are arranged at shorter intervals so as to obtain a high-density ink jet head, a yield decrease might be caused due to defective bonding or damage to the diaphragms when an electrode substrate is bonded to a silicon substrate as a diaphragm substrate having the diaphragms formed by performing anisotropic etching on the silicon substrate. Also, misalignment is often caused, and a number of bonding processes need to be performed. In view of this, this conventional ink jet head is not suitable for mass production.

On the other hand, if a silicon substrate is used as an electrode substrate while an n-type or p-type impurity layer is used as electrodes (as disclosed in Japanese Laid-Open Patent Application No. 6-71882), it is easier to form narrow gaps between the diaphragms and the electrodes than in the case where a metal film that might generate particles at the time of film formation is used. Also, a high-quality thermal oxide film can be formed as an electrode protection film on the electrodes. However, junction leak or punch-through between the electrodes is caused, resulting in poor reliability.

SUMMARY OF THE INVENTION

It is a general object of the present invention to provide ink jet heads and methods of producing the same, in which the above-mentioned problems are eliminated.

A more specific object of the present invention is to provide a high-density ink jet head having external electrodes that can be easily connected to an external circuit, and a method of producing this ink jet head without increasing the number of production steps.

The above objects of the present invention are achieved by an ink jet head having a diaphragm external electrode that located on the same plane as diaphragms. Accordingly, the ink jet head can be easily connected to an external circuit without using a special FPC.

The above ink jet head further includes individual external electrodes disposed within 2 $\mu$m from the diaphragm external electrode, so that the ink jet head can be more easily connected to an external circuit.

In the above ink jet head, the individual external electrodes are aligned with the diaphragm external electrode, so that the ink jet head can be easily connected to an external circuit without using a special FPC.

In the above ink head, the diaphragms and the diaphragm external electrode are formed on a first substrate, the electrodes and the individual external electrodes are formed on a second substrate, and parts of the first substrate corresponding to the individual external electrodes on the second substrate are removed while the diaphragm external electrode is maintained. Accordingly, a decrease in yield due to defective bonding or damage to the diaphragms can be prevented. Furthermore, the formation of the diaphragm external electrode and the exposure of the individual external electrodes can be carried out at the same time.

In the above ink jet head, the diaphragms and the diaphragm external electrode are formed on a first substrate, and a metal layer is formed on the diaphragm external electrode. Thus, the corrosion resistance to etching of the ink jet head can be increased.

In the above ink jet head, the metal layer on the diaphragm external electrode has a multi-layered structure. Thus, the corrosion resistance can be increased, and the production costs can be reduced.

In the above ink jet head, a layer of the metal layer in contact with the first substrate is made of a metal that can be in ohmic contact with silicon. Thus, the contact resistance of the ink jet head can be reduced.

In the above ink jet head, the outermost layer of the metal layer is made of a metal that has resistance against an etching species based on halogen. Thus, the ohmic contact can be easily achieved while the corrosion resistance is maintained.

The objects of the present invention are also achieved by a method of producing an ink jet head, comprising the steps of:

bonding a first substrate having diaphragms and a diaphragm external electrode formed thereon to a second substrate having electrodes and individual external electrodes formed thereon, with a predetermined distance being left between each of the diaphragms and each corresponding one of the electrodes;

forming a contact portion having the same thickness as the diaphragms, the contact portion including at least a region on the first substrate corresponding to a region including the individual external electrodes on the second substrate and a part to become the diaphragm external electrode; and removing the region of the contact portion except the part to become the diaphragm external electrode. In accordance with this method, an ink jet head having a diaphragm external electrode that can be easily connected to a connector such as an FPC can be obtained without increasing the number of production steps.

In the above method, the bonding step is an anodic bonding step that includes the steps of forming a $SiO_2$-film gap spacer on the first substrate that is a monocrystal silicon substrate, or forming concave portions in the second substrate that is a glass substrate, so that the predetermined distance is maintained between each of the diaphragms and each corresponding one of the electrodes. Thus, an ink jet head having a diaphragm external electrode that can be easily connected to a connector such as an FPC can be obtained without increasing the number of production steps.

In the above method, the bonding step includes the steps of:

forming a $SiO_2$-film gap spacer in the first substrate that is a monocrystal silicon substrate and/or in the second substrate that is also a monocrystal silicon substrate; and bonding the first substrate and the second substrate directly to each other, so that the predetermined distance is maintained between each of the diaphragms and each corresponding one of the electrodes. Accordingly, an ink jet head having a diaphragm external electrode that can be easily connected to a connector such as an FPC can be obtained without increasing the number of production steps, and narrow gaps can be formed with great precision.

The above method may further comprise the step of forming a protection film having resistance to etching on the part to become the diaphragm external electrode, prior to the removing step. Accordingly, etching margins can be increased, and excellent ohmic contact can be achieved.

The above method may further comprise the step of forming a protection film having resistance to etching in the region other than the region to be removed from the first substrate by etching, prior to the removing step. Accordingly, etching can be performed without a mask. Thus the production costs and the number of production steps can be reduced. Also, a decrease in yield can be restricted. Furthermore, the bonding of liquid chambers formed on the diaphragm substrate becomes easier, and the wettability can be increased.

In the above method, the relationships $(a/x)>1$ and $(a/y)<1$, are satisfied, wherein: x represents a short side of an opening of each of the diaphragms; y represents a short side of the contact portion; and a represents a thickness of the first substrate. Accordingly, etching can be performed without a mask, and the production costs and the number of production steps can be reduced. Also, a decrease in yield can be restricted. Furthermore, side etching can be avoided, and contamination on the bonding surfaces of the liquid chambers formed on the diaphragm substrate can be prevented.

In the above method, when etching is performed on the first substrate, a part between the part to become the diaphragm external electrode and the adjacent individual external electrode is maintained. Accordingly, the size the diaphragm external electrode can be desirably controlled.

In the above method, the relationships, $(a/x)>1$, $(a/z)>1$, and $(a/y)<1$, are satisfied, wherein: x represents a short side of an opening of each of the diaphragms; y represents a short side of the contact portion; z represents a short side of the diaphragm external electrode; and a represents a thickness of the first substrate. Accordingly, etching can be performed without a mask, and the production costs and the number of production steps can be reduced. Also, a yield decrease can be restricted.

The above method may further comprise the steps of:

forming a p-type or n-type impurity layer on a part of each of the electrodes adjacent to each corresponding one of the diaphragms;

forming a heat-resistant film on the contact portion; and forming a connecting hole between the impurity layer and the heat resistant film. Accordingly, the reliability of the electrode substrate can be increased.

The objects of the present invention are also achieved by a method of producing an ink jet head, comprising the steps of:

bonding a silicon wafer that is a first substrate having diaphragms and a diaphragm external electrode formed thereon to a second substrate having electrodes and individual electrodes formed thereon;

performing etching on the first substrate, leaving a contact portion including a region corresponding to the individual external electrodes on the second substrate and a part to become the diaphragm external electrode;

cutting the silicon wafer into head chips; and removing the region corresponding to the individual external electrodes from the contact portion. Accordingly, an ink jet head having high reliability can be obtained at low production costs.

In the above method, when the diaphragm external electrode is formed, a metal layer having a low etching rate compared with silicon is formed on the part to become the diaphragm external electrode. Accordingly, the first substrate can be protected from corrosion when the diaphragm external electrode is formed on the first substrate.

In the above method, an etching mask made of a material that does not generate a product is used. Accordingly, the reliability in connection with a connector can be increased.

In the above method, the etching mask may be made of quartz. Accordingly, the reliability in connection with a connector can be further increased.

In the above method, the etching mask may be made of alumina. Accordingly, the reliability in connection with a connector can be further increased.

Other objects and further features of the present invention will become more apparent from the following description taken in conjunction with the accompanying drawings.

DESCRIPTION OF THE PREFERRED EMBODIMENTS

The following is a description of embodiments of the present invention, with reference to the accompanying drawings.

Figure 1:
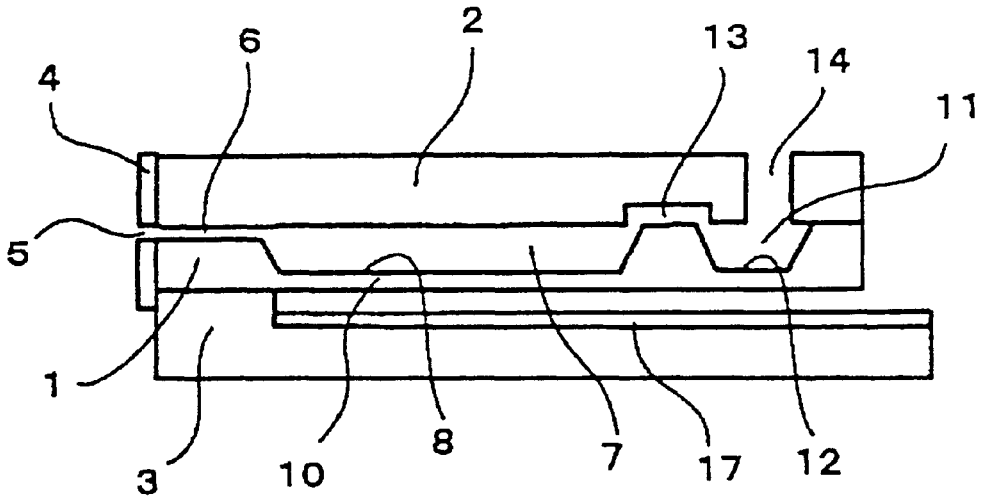
FIG. 1 is a schematic sectional view of an electrostatic ink jet head of the present invention.
Figure 2:
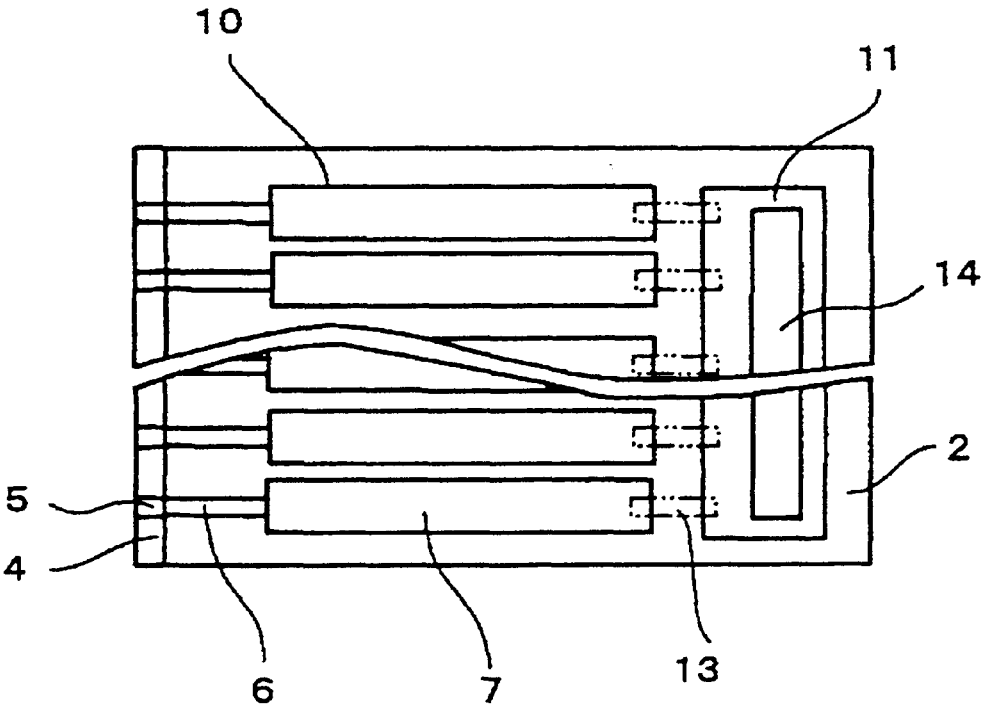
FIG. 2 is a plan view of the ink jet head of FIG. 1.

As shown in FIGS. 1 and 2, an ink jet head of the present invention comprises a first substrate 1, a cover member 2 disposed above the first substrate 1, an electrode substrate 3 disposed under the first substrate 1, and a nozzle plate 4 disposed on the front side of the first substrate 1 and the cover member 2.

The first substrate 1 includes ink discharging grooves 6 that communicate with nozzle holes 5 formed in the nozzle plate 4, concave portions 8 that form discharging chambers 7 communicating with the ink discharging grooves 6, diaphragms 10 that can be deformed and forms the bottom walls of the discharging chambers 7, and a concave portion 12 that forms a common ink passage 11 for supplying ink into the discharging chamber 7. The cover member 2 includes ink supply passages 13 that also serve as fluid resistors and connecting the discharging chambers 7 to the common ink passage 11, and an ink supply port 14 for feeding ink from the outside into the common ink passage 11. The electrode substrate 3 has electrodes 17 adjacent to the diaphragms 10 at a predetermined distance. The electrodes 17 an d the diaphragms 10 constitute an actuator unit.

In this ink jet head, the diaphragms 10 are deformed by electrostatic force caused by a driving voltage applied between the diaphragms 10 and t he electrodes 17, so that the content volume of each of the discharging chambers 7 is changed to discharge ink droplets through the nozzle hole s 5.

The embodiments of the above electrostatic ink jet head will be hereinafter described. In FIGS. 3 to 10C, liquid chambers and nozzle holes formed on the diaphragm substrate, or liquid chamber forming members that form liquid chambers and nozzles in contact with the diaphragm substrate, are not shown as a matter of convenience.

For the diaphragm substrate, a silicon substrate of plane orientation (110) on which a high-concentration boron layer that can spontaneously stop anisotropic etching using a potassium hydroxide (KOH) solution is used. On the other hand, a glass substrate is used for the electrode substrate, i.e., the second substrate. However, both first and second substrates are not limited to those examples. For instance, an SOI substrate may be used as the diaphragm substrate, and dry etching may be performed for forming the diaphragms. Also, a silicon substrate may be used as the electrode substrate.

Figure 3:
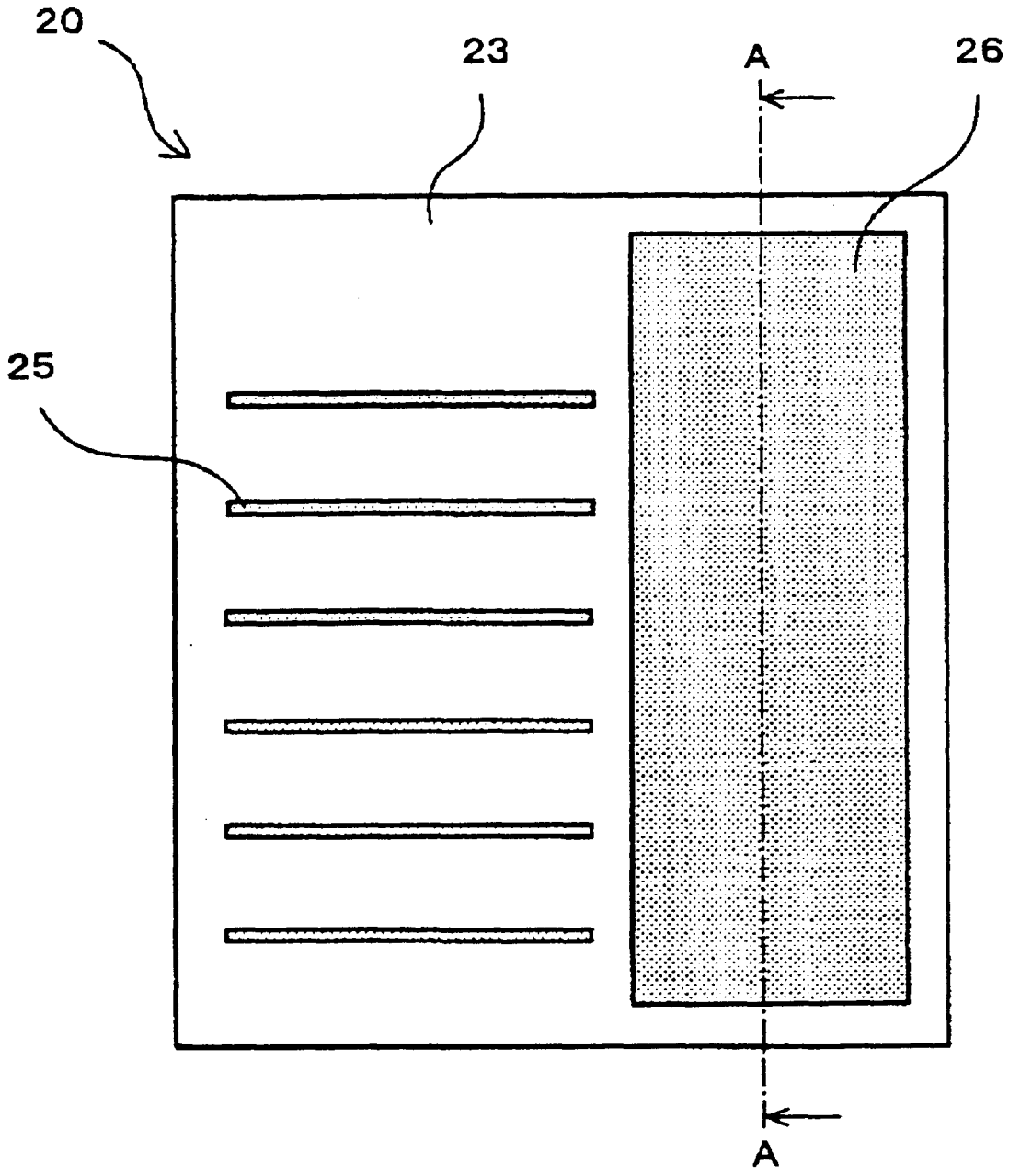
FIG. 3 is a plan view of a diaphragm substrate of a first embodiment of the present invention.
Figure 4A:
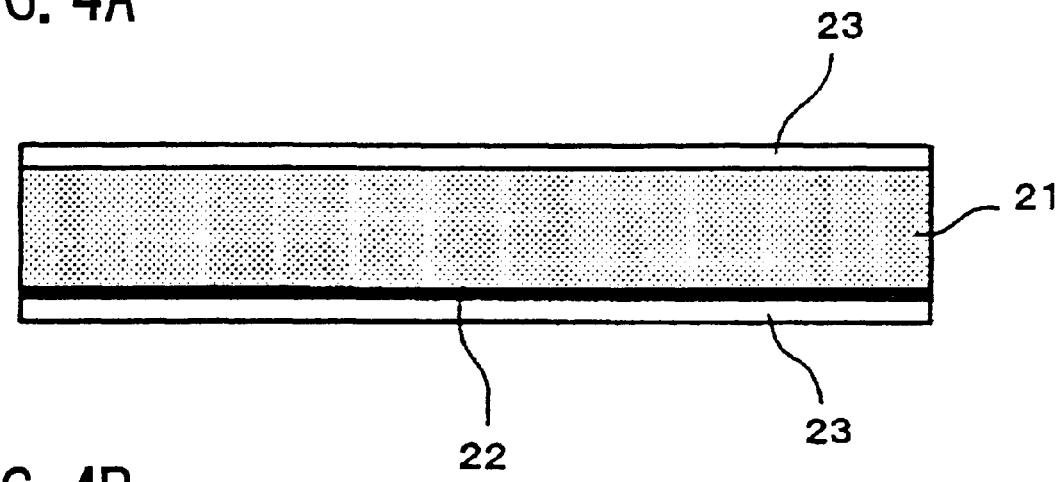
FIGS. 4A to 4C are sectional views of the diaphragm substrate taken along the line A—A of FIG. 3, illustrating the production procedures thereof.
Figure 4B:
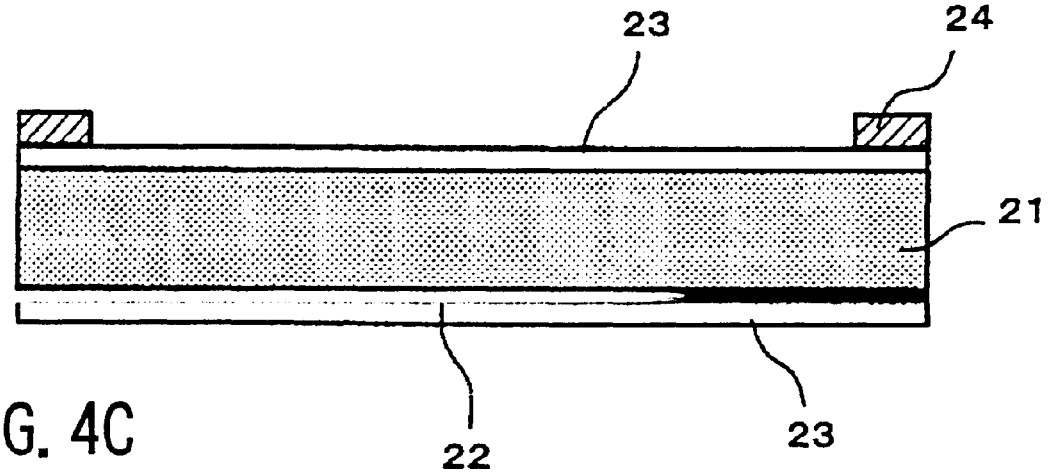
Figure 4C:
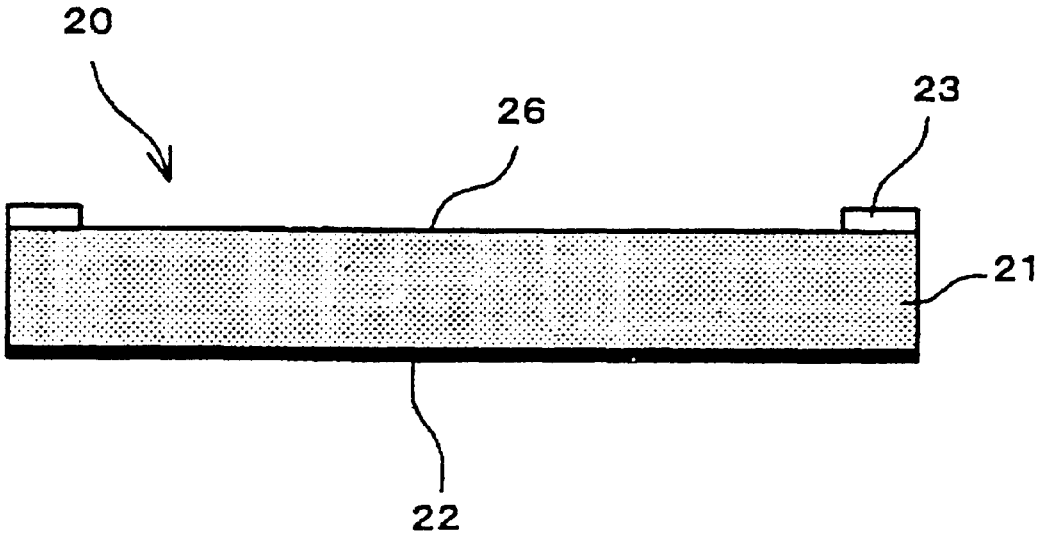

Referring to FIG. 3 and FIGS. 4A to 4C, the procedures of producing a diaphragm substrate 20 will be described. FIG. 3 is a plan view of a diaphragm substrate prior to the bonding to an electrode substrate. FIGS. 4A to 4C are sectional views of the diaphragm substrate taken along the line A—A of FIG. 3.

To form diaphragms 25 having a desired thickness (3 $\mu$m, for instance), a 3 $\mu$m-thick high-concentration boron layer 22 is formed on a silicon substrate 21 that is a first substrate as a diaphragm substrate through an injection step and an impurity diffusion step. LPCVD-SiN films 23 as etching masks are then formed on the upper and lower surfaces, as shown in FIG. 4A. The etching masks may be $SiO_2$ films or laminated films of $SiO_2$ films and SiN films.

Next, photoresists 24 are patterned as shown in FIG. 4B, so that silicon etching is performed to form the diaphragms 25 and a contact portion 26 on the silicon substrate 21, as shown in FIG. 3. The SiN film 23 on the patterning surface (i.e., the exposed part of the SiN film 23 on the upper surface) and the SiN film 23 on the entire lower surface are removed, and the photoresists 24 are removed, as shown in FIG. 4C. In this manner, the diaphragm substrate 20 having the diaphragms 25 and the contact portion 26 patterned on the silicon substrate 21 as shown in FIG. 3 can be obtained.

The contact portion 26 is a region including individual external electrodes 34 for electrodes 33 formed on an electrode substrate 30, and is also an area that forms a diaphragm external electrode. The contact portion 26 should be larger than the area of the individual external electrodes 34.

Figure 5:
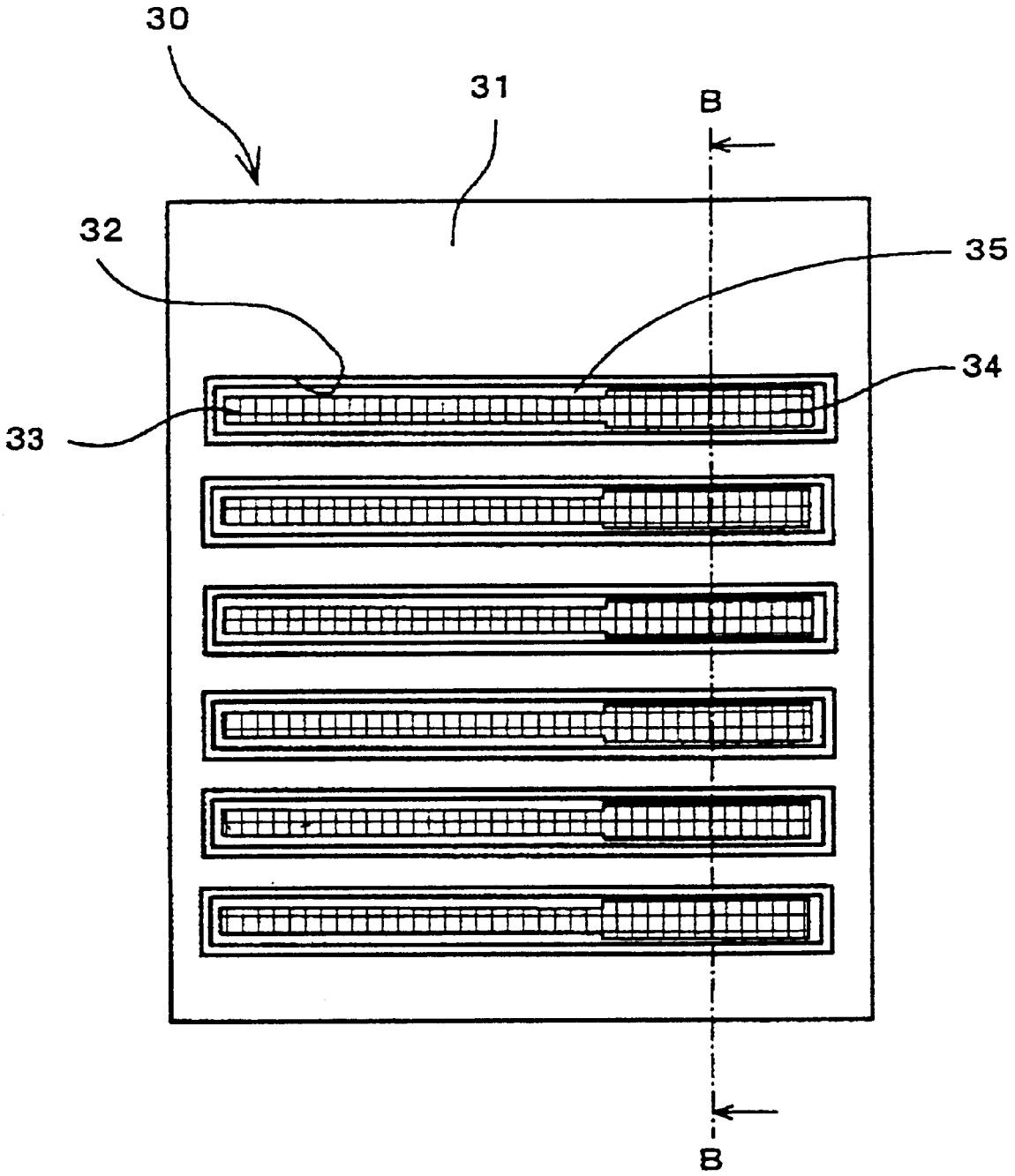
FIG. 5 is a plan view of an electrode substrate of the first embodiment of the present invention.
Figure 6A:
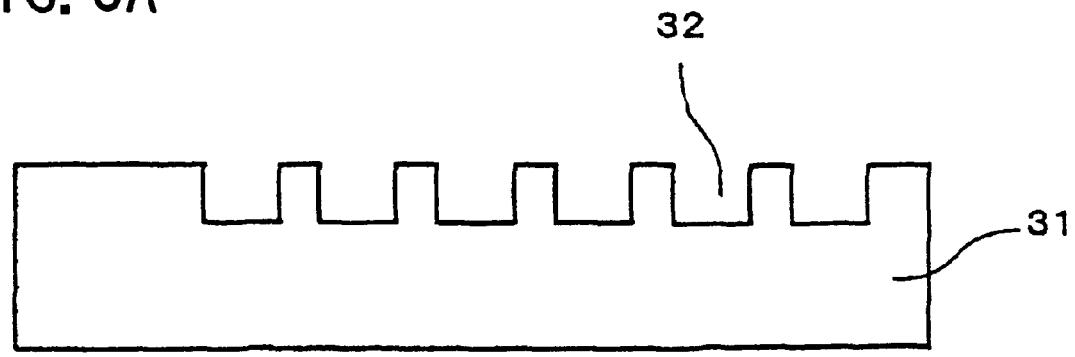
FIGS. 6A to 6C are sectional views of the electrode substrate taken along the line B—B of FIG. 5, illustrating the production procedures thereof.

Referring now to FIG. 5 and FIGS. 6A to 6C, the procedures of producing the electrode substrate 30 will be described. As shown in FIGS. 5 and 6A, concave portions (hereinafter referred to as "gaps") 32 are formed in a glass substrate 31 that is a second substrate, so that gaps are created between the diaphragms 25 and the electrodes 33. These gaps 32 are created by forming a pattern corresponding to the gaps 32 on the glass substrate 31 and then etching the pattern with hydrofluoric acid by a depth of 0.5 $\mu$m.

Figure 6B:
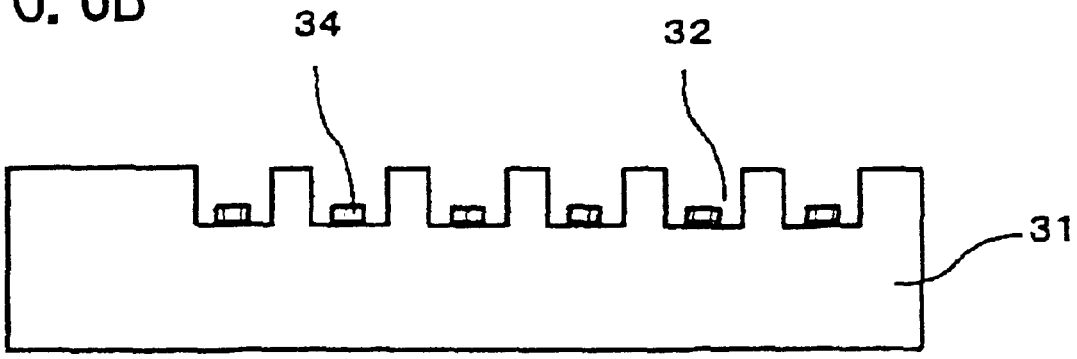

As shown in FIG. 5 and FIG. 6B, the electrodes 33 and the individual external electrodes 34 extending from the electrodes 34 are formed in the gaps 32. The electrodes 33 and the individual external electrodes 34 are prepared by forming a 0.2 $\mu$m thick film from nickel by a sputtering method, and then patterning the film by a photolithography technique.

Although nickel is used for the electrodes 33 and the individual external electrodes 34 in this embodiment, it is also possible to use aluminum or gold to form the electrodes 33 and the individual external electrodes 34. For instance, it is possible to use a metallic material normally used for forming a semiconductor chip, such as Al, Cr, or Ni, a metal having a high melting point, such as Ti, TiN, or W, or a polycrystal silicon material having a low-resistance due to impurities. When a silicon substrate is employed the second substrate, the impurity diffusion region is used. Here, the impurities utilized for diffusion indicates the opposite conductivity to the conductivity of the silicon substrate, so that a pn junction is formed in the vicinity of the diffusion region, and the electrodes 33 and individual external electrodes are electrically insulated from the second substrate.

Figure 6C:
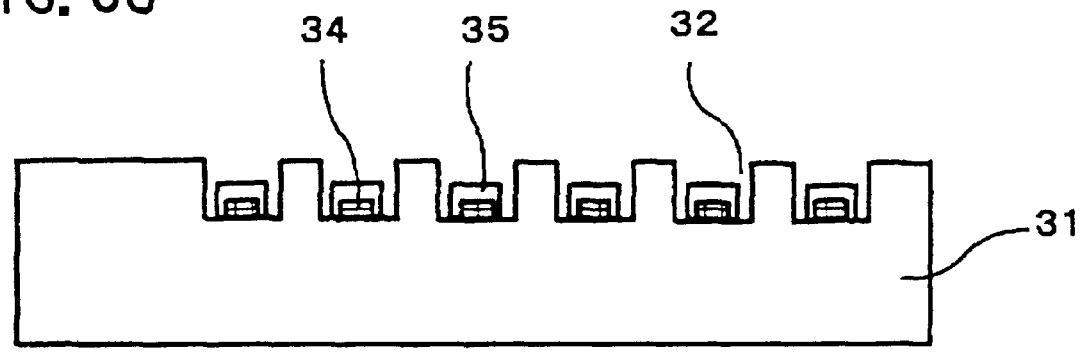

Insulating electrode protection films 35 are then formed on the electrodes 33 and the individual external electrodes 34, as shown in FIGS. 5 and 6C. To obtain the electrode protection films 35, a 0.1 $\mu$m thick $SiO_2$ film is formed by a sputtering method, and the $SiO_2$ film is then patterned by a photolithography technique. In this manner, the electrode substrate 30 having the electrodes 33 and the individual external electrodes 34 formed in the gaps 32 and covered with the electrode protection films 35 is obtained.

Figure 7:
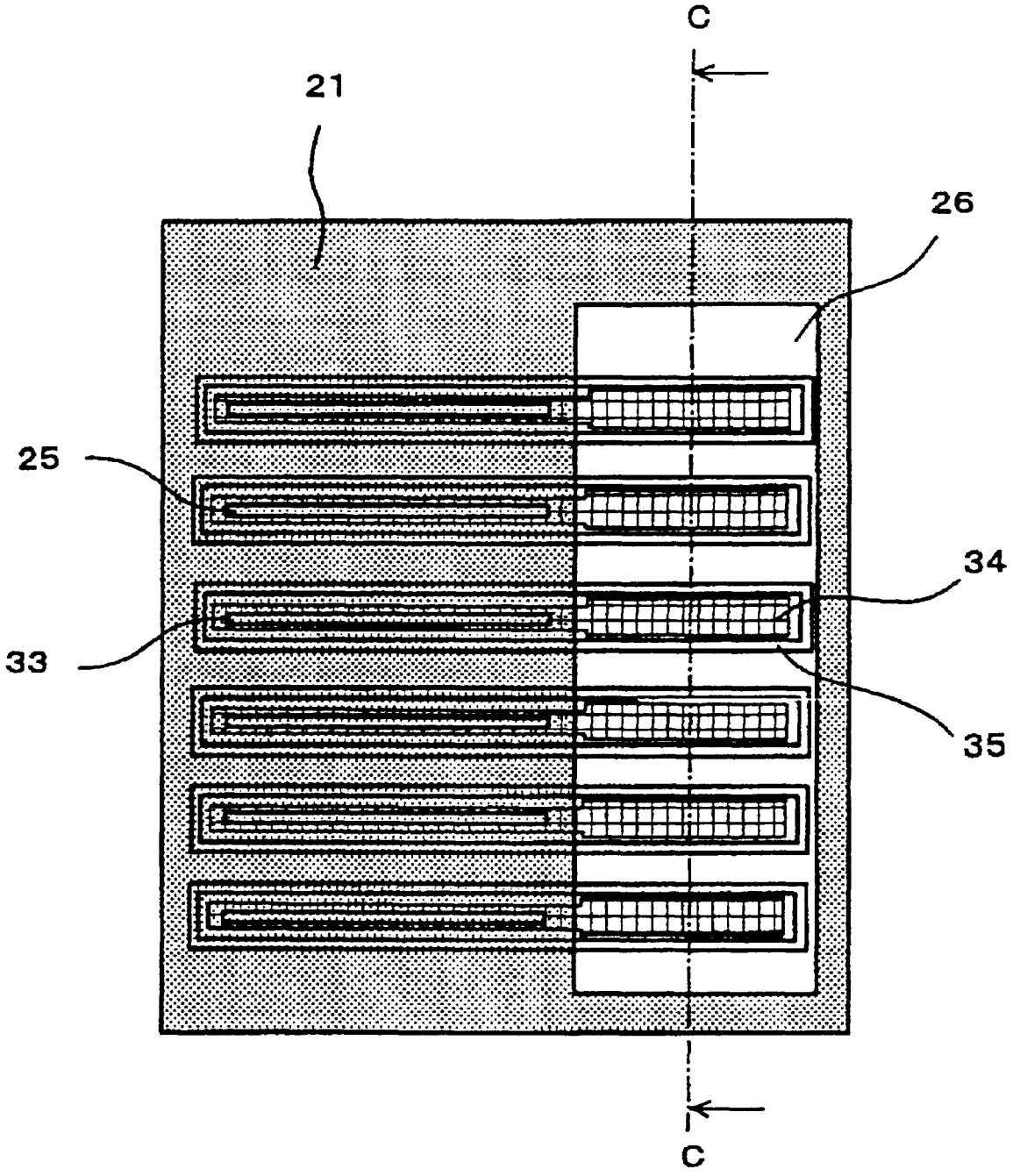
FIG. 7 is a plan view of the joined diaphragm substrate and the electrode substrate, with diaphragms being formed thereon.
Figure 8A:
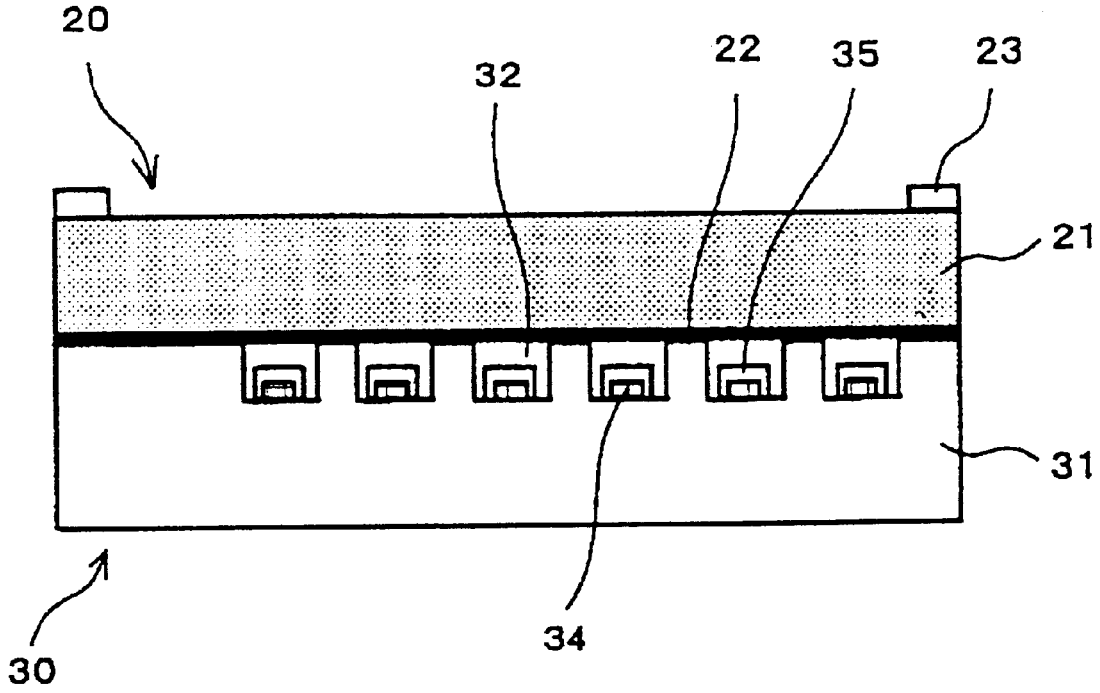
FIGS. 8A and 8B are sectional views of the joined diaphragm substrate and the electrode substrate taken along the line C—C of FIG. 7, illustrating the bonding procedure and the diaphragm forming procedures.
Figure 8B:
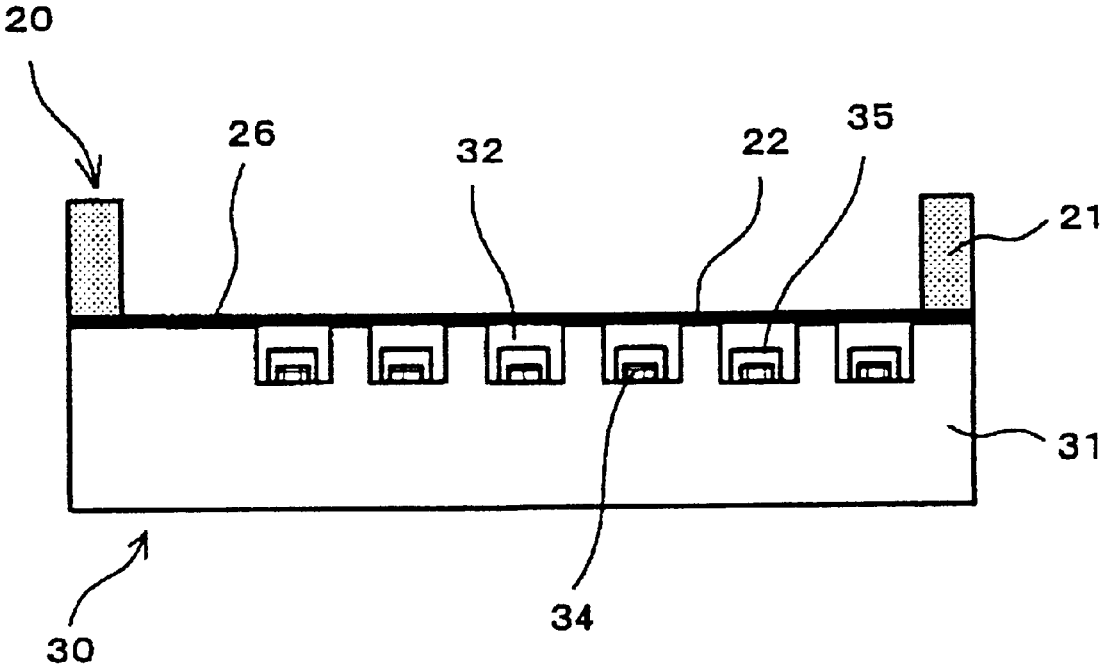

Referring now to FIG. 7 and FIGS. 8A and 8B, the procedures of bonding the diaphragm substrate 20 and the electrode substrate 30 to each other and forming the diaphragms will be described. First, the diaphragm substrate 20 and the electrode substrate 30 are bonded to each other, as shown in FIG. 8A, by an anodic bonding technique at 500 V and 400° C. Under this condition, each of the diaphragms 25 on the diaphragm substrate 20 is adjacent to each corresponding electrode 33 on the electrode substrate 30 at a predetermined distance. At the same time, the contact portion 26 of the diaphragm substrate 20 faces the individual external electrodes 34 on the electrode substrate 30.

As shown in FIG. 8B, the silicon substrate 21 as the first substrate is subjected to anisotropic etching using a potassium hydroxide (KOH) solution, with the LPCVD-SiN film 23 of the diaphragm substrate 20 being the mask. Since the etching rate drops suddenly on the high-concentration boron layer 22, the diaphragms 25 and the contact portion 26 having a thickness of 3 $\mu$m are accurately formed from the high-concentration boron layer 22 on the diaphragm substrate 20. Also, the LDCVD-SiN film 23 used as the etching mask for the diaphragm substrate 20 is removed.

In the above manner, a bonding member that comprises the diaphragm substrate 20 and the electrode substrate 30 bonded to each other can be obtained, with the diaphragms 25 of the diaphragm substrate 20 being adjacent to the electrodes 33 of the electrode substrate 30 at a predetermined distance, and with the contact portion 26 of the diaphragm substrate 20 being adjacent to the individual external electrodes 34 of the electrode substrate 30.

Referring now to FIG. 9 and FIGS. 10A to 10C, the procedures of forming a diaphragm external electrode 27 on the above bonding member comprising the diaphragm substrate 20 and the electrode substrate 30, with the individual external electrodes 34 being exposed will be described. In these procedures, the formation of the diaphragm external electrode 27 by silicon etching on the contact portion 26 of the diaphragm substrate 20 and the exposure of the individual external electrodes 34 are carried out at the same time. However, wet etching is not preferable in this embodiment, because the etching liquid will enter the gaps 32. Accordingly, dry etching is carried out for the silicon etching.

Figure 10A:
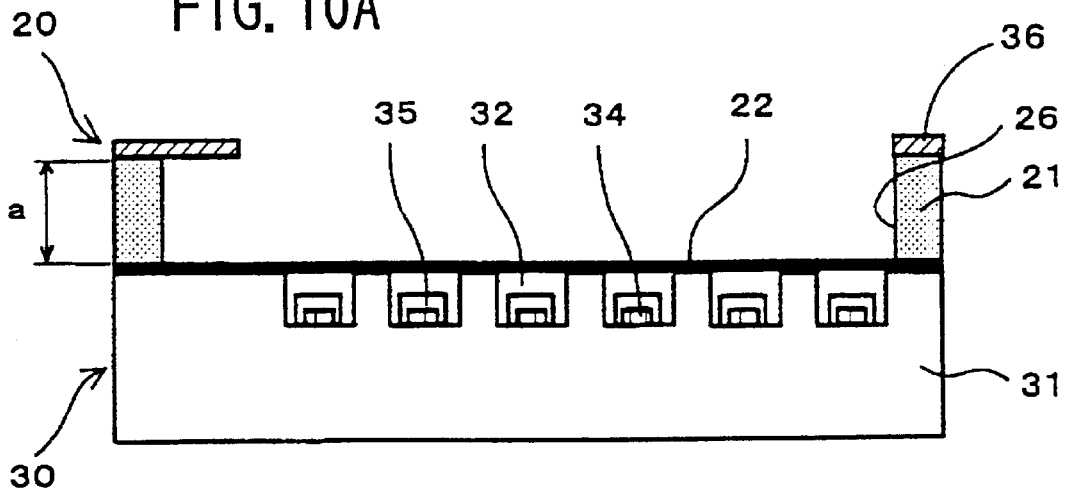
FIGS. 10A to 10C are sectional views of the joined diaphragm substrate and the electrode substrate taken along the line D—D of FIG. 9, illustrating the production procedures of the external electrodes.

As shown in FIG. 10A, an etching metal mask 36 is set on the diaphragm substrate 20. This metal mask 36 has a pattern formed so that only the diaphragm external electrode 27 remains in a predetermined region of the contact portion 26 of the diaphragm substrate 20, and that the rest of the contact portion 26 is removed, as shown in FIG. 10B, by silicon dry etching using a gas mainly containing $SF_6$.

Figure 9:
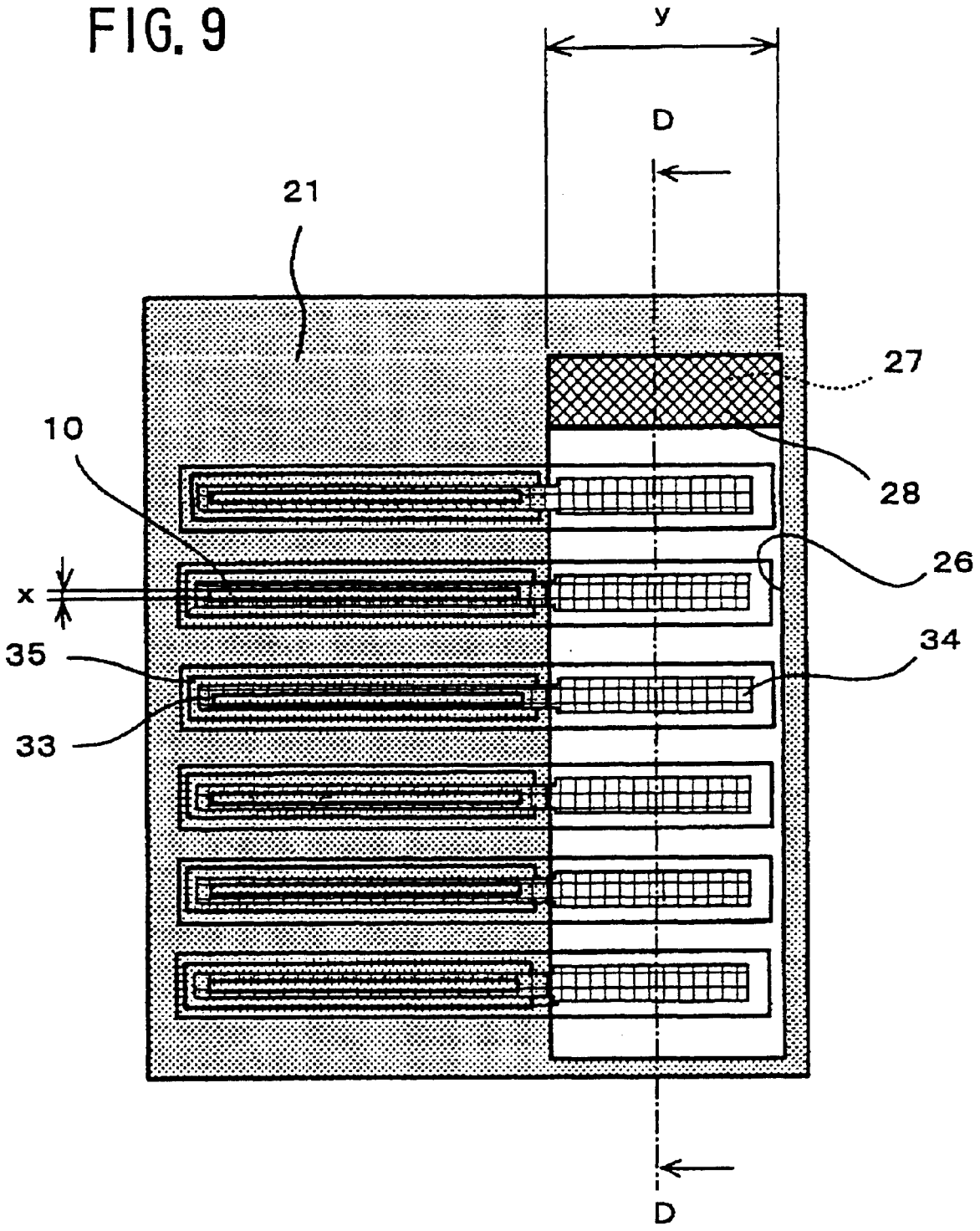
FIG. 9 is a plan view of the joined diaphragm substrate and the electrode substrate, with external electrodes being formed thereon.
Figure 10B:
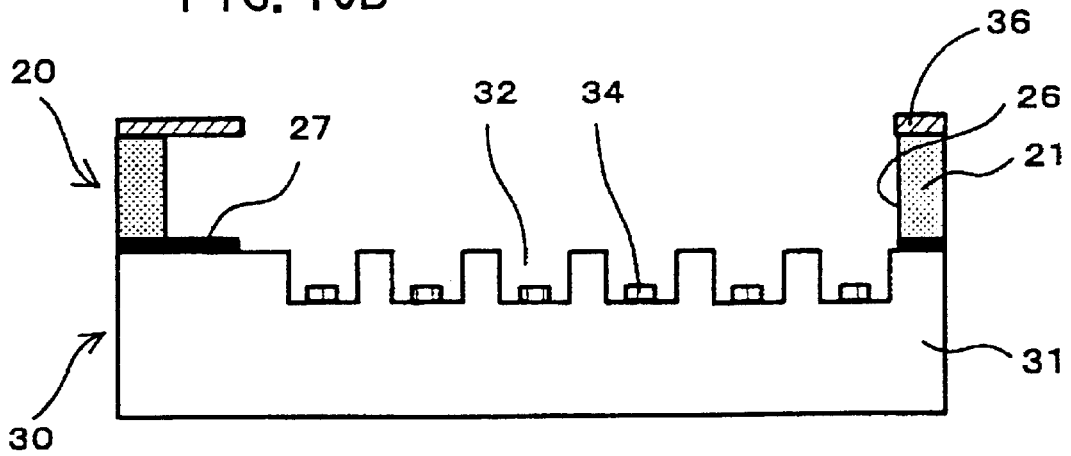

In the above manner, the diaphragm external electrode 27 is formed as shown in FIG. 10B and FIG. 9. Further, the electrode protection film ($SiO_2$ film) 35 on the individual external electrodes 34 is removed by $SiO_2$ dry etching using a gas mainly containing $CHF_3$, so that the individual external electrodes 34 ma de of nickel become exposed. Since the depth of each gap 32 is 0.5 $\mu$m and the thickness of each individual external electrode 34 is 0.2 $\mu$m, the diaphragm external electrode 27 is preferably located within 2 $\mu$m from the individual external electrodes 34 in the vertical direction.

Figure 10C:
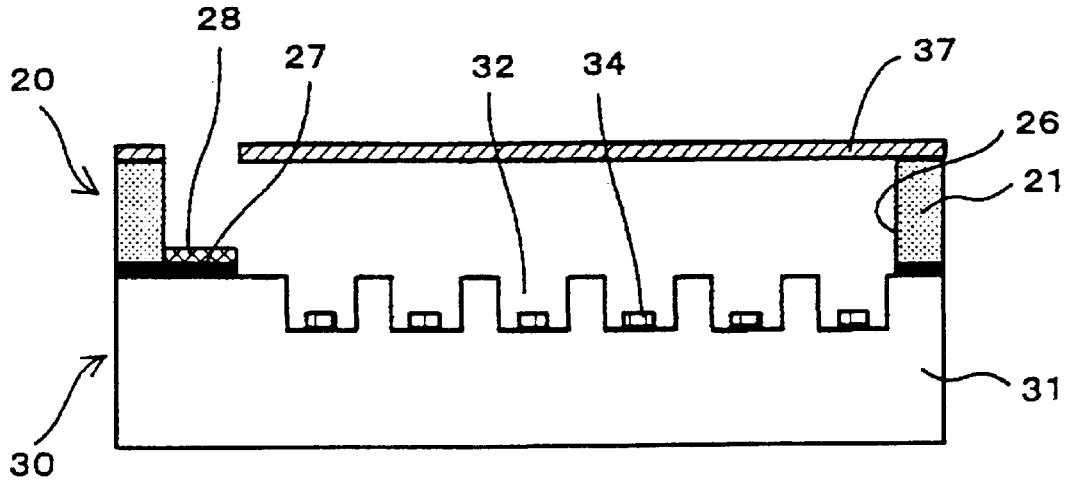

Since the diaphragm external electrode 27 is formed from the high-concentration boron layer 22 in this embodiment, ohmic contact with an FPC electrode can be achieved without metal coating, and the production of the diaphragm external electrode 27 can be finished at this stage. However, it is preferable to coat the diaphragm external electrode 27 with a metal film. Therefore, as shown in FIG. 10C, a metal mask 37 having a pattern to coat only the diaphragm external electrode 27 with a metal film is set is set on the diaphragm substrate 20. A metal film 28 is then formed by a low-resistance heating deposition method, for instance, thereby ending the production of the diaphragm external electrode 27.

In the above manner, the ink jet head (an actuator) in which the diaphragm external electrode 27 having the same thickness as the diaphragms 25 is located on the same plane as the diaphragms 25, and is located within 2 $\mu$m from the individual external electrodes 34 for the electrodes 33 in the vertical direction, can be obtained.

Since the diaphragm external electrode 27 is located on the same plane as the diaphragms 25, the vertical distance between the diaphragm external electrode 27 and the individual external electrodes 34 can be made shorter. With such a short vertical distance between the diaphragm external electrode 27 and the individual external electrodes 34, the diaphragms 25 and the electrodes 33 can be easily connected to an external circuit by a connector including lead wires such as an FPC.

With the diaphragm external electrode 27 being located on the same plane as the diaphragms 25, the vertical distance between the diaphragm external electrode 27 and the individual external electrodes 34 can be made within 2 $\mu$m. With such a short vertical distance between the diaphragm external electrode 27 and the individual external electrodes 34, the diaphragms 25 and the electrodes 33 can be more easily connected to an external circuit by a connector including lead wires such as an FPC.

Also, since the diaphragm external electrode 27 and the individual external electrodes 34 are aligned, the diaphragm external electrode 27 and the individual external electrodes 34 can be collectively connected by a connector. Accordingly, the connecting process is easier, and there is no need to employ a special-purpose connector having a top end that branches into two parts used in the prior art. Thus, a cost increase can be avoided.

In this embodiment, the diaphragm external electrode 27 is located with respect to the individual external electrodes 34 within the distance from the diaphragms 25 (0.5 $\mu$m in this embodiment). The distance between the diaphragms 25 and the electrodes 33 should be preferably within 2 $\mu$m, so that the diaphragms 25 can be displaced, and the driving voltage can be lowered. Accordingly, the diaphragm external electrode 27 can be easily also located within 2 $\mu$m from the individual external electrodes 34 in the vertical direction.

In this embodiment, the diaphragms 25 and the diaphragm external electrode 27 are formed on the first substrate, while the electrodes 33 and the individual external electrodes 34 are formed on the second substrate. The part of the first substrate corresponding at least to the individual external electrodes 34 is removed, with only the diaphragm external electrode 27 remaining. After the first substrate and the second substrate are bonded to each other, the diaphragms can be formed. Accordingly, a decrease in yield due to defective bonding or damage in the diaphragms 25 can be avoided. Furthermore, the formation of the diaphragm external electrode 27 and the exposure of the individual external electrodes 34 can be carried out at the same time.

As described above, after the first substrate and the second substrate are bonded to each other, with a predetermined gap being left between each diaphragm 25 and each corresponding electrode 33, the contact portion 26 having the same thickness as the diaphragms 25 and including the regions corresponding the individual external electrodes 34 and the diaphragm external electrode 27 is formed on the first substrate by an etching technique. The contact portion except the part corresponding to the diaphragm external electrode 27 is removed so as to form the diaphragm external electrode 27. According to the above procedures, the number of steps is not increased, and the diaphragm external electrode 27 having the same thickness as the diaphragms 25 is located on the same plane as the diaphragms 25, so that the diaphragm external electrode 27 is located within 2 $\mu$m from the individual external electrodes 34 in the vertical direction. Thus, an ink jet head that is easy to connect to an external circuit by a connector including lead wires such as FPC can be obtained.

A monocrystal silicon substrate is used as the first substrate, and a glass substrate is used as the second substrate in this embodiment. Concave portions are formed in the second substrate. The first substrate and the second substrate are bonded to each other, with a predetermined distance being kept between each diaphragm 25 and each corresponding electrode 33. Alternatively, a $SiO_2$ film gap spacer is formed in the first substrate, and the first substrate and the second substrate are then bonded to each other, with a predetermined distance being kept between each diaphragm 25 and each corresponding electrode 33. In either way, the number of production steps is not increased, and an ink jet head that can be easily connected to an external circuit by a connector can be obtained.

A monocrystal silicon substrate may be used for the first substrate and the second substrate. A $SiO_2$ gap spacer is formed in either the first substrate or the second substrate, or both in the first substrate and the second substrate. The first substrate and the second substrate can be bonded directly to each other, with a predetermined distance being kept between each diaphragm 25 and each corresponding electrode 33. In this manner, the number of production steps is not increased, and an ink jet head that can be easily connected to an external circuit by a connector can be obtained. Also, etching defects that might be caused in a glass substrate can be avoided, and narrow gaps can be accurately formed.

Next, a second embodiment of the present invention will be described. In the second embodiment, the procedures from the beginning until the diaphragm formation are the same as in the first embodiment, but the external electrode formation after the diaphragm formation is different.

More specifically, when the diaphragm external electrode 27 is coated with a metal film, the deposition metal mask 37 shown in FIG. 10C is formed prior to the silicon etching of the contact portion 26. The metal film 28 having resistance to silicon etching is formed on the region to be the diaphragm external electrode 27 in the contact portion 26. The other region of the contact portion 26 is etched to form the diaphragm external electrode 27 and to remove the electrode protection film 35 for the individual external electrodes 34.

If the silicon dry etching is carried out only with the etching metal mask 36, side etching is liable to occur below the metal mask 36, which makes the formation of the diaphragm external electrode 27 inaccurate. Therefore, the metal film 28 having resistance to silicon etching is formed in advance, so as to allow wider etching margins for the diaphragm external electrode 27.

In this embodiment, the metal film 28 having the resistance to silicon etching is made of gold, but it is also possible to be made of aluminum or nickel. Prior to the formation of the metal film 28, it is preferable to rinse the diaphragm external electrode 27 with an HF etchant, so that a possibility of forming an insulating film such as a natural oxide film between the diaphragm external electrode 27 and the metal film 28 can be low. Thus, more preferable ohmic contact can be achieved.

In the above manner, the region covered with the metal film 28 can never be etched, and certainly remains after the removal of the regions of the contact portion 26 other than the region of the diaphragm external electrode 27. Accordingly, wider etching margins are allowed for the etching of the contact portion 26 to form the diaphragm external electrode 27. Also, a rinse with an HF etchant can be carried out prior to the formation of the metal film 28. Thus, an insulating film cannot be formed between the diaphragm external electrode 27 and the metal film 28, and good ohmic contact can be achieved.

Figure 11:
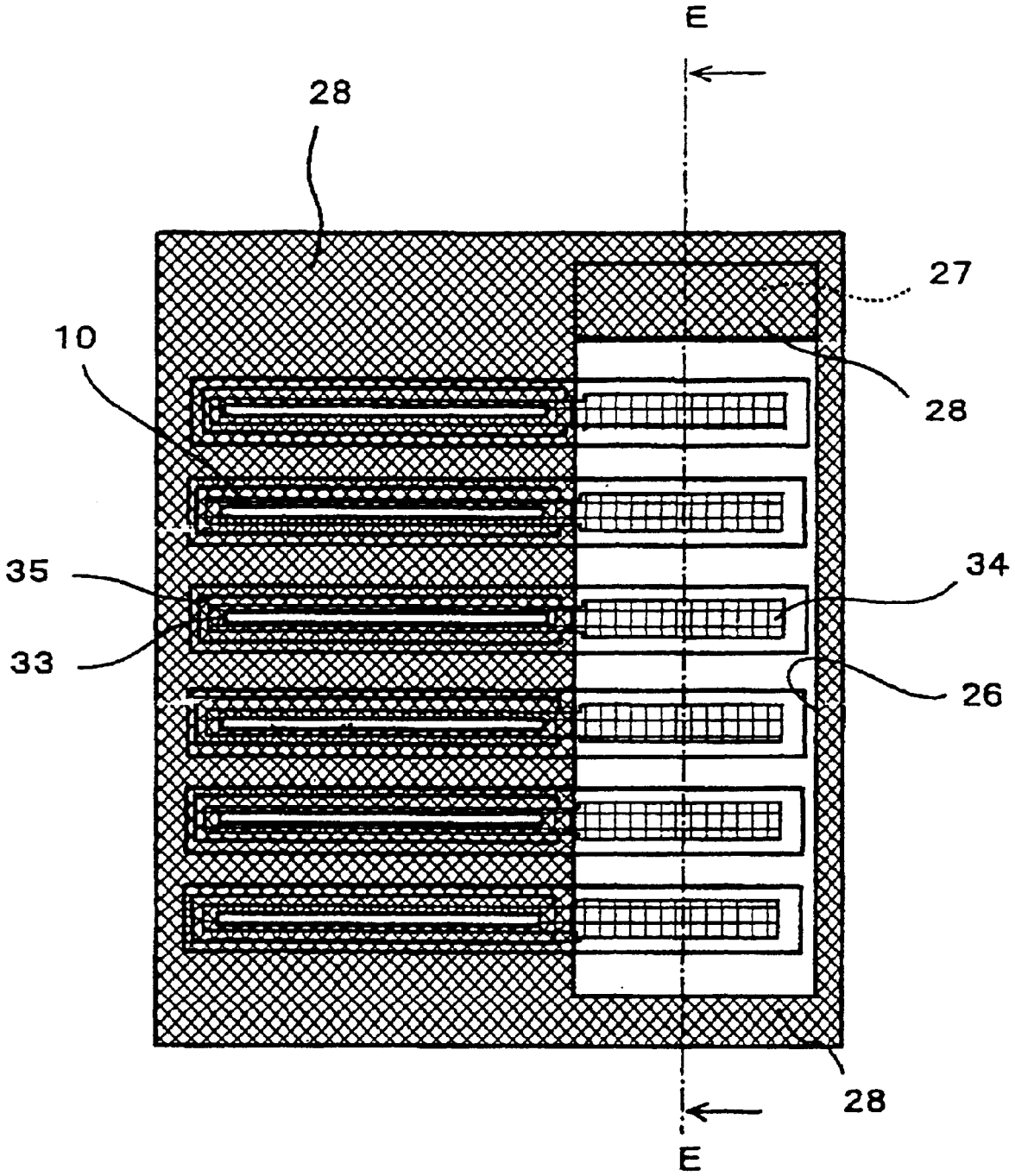
FIG. 11 is a plan view of an ink jet head of a third embodiment of the present invention.
Figure 12A:
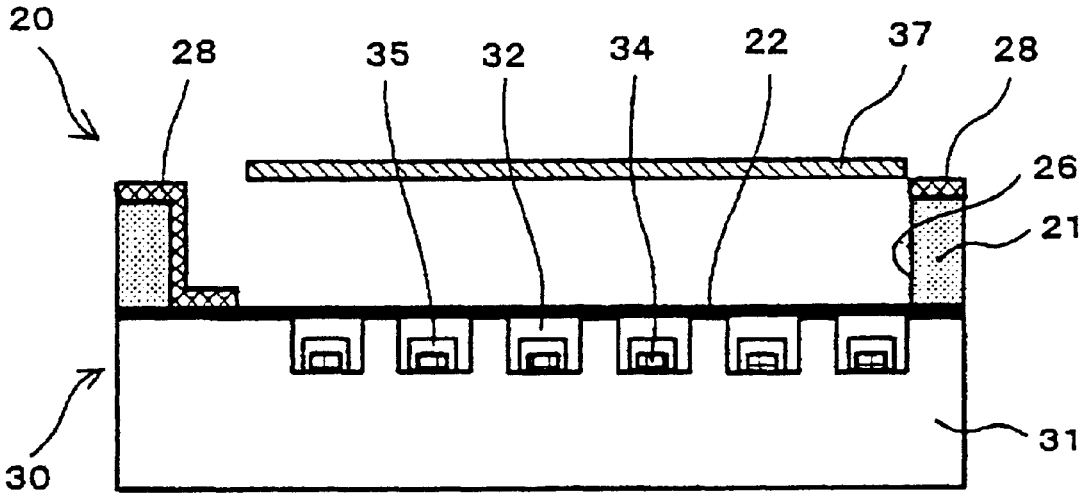
FIGS. 12A and 12B are sectional views of the ink jet head taken along the line E—E of FIG. 11, illustrating the production procedures thereof.
Figure 12B:
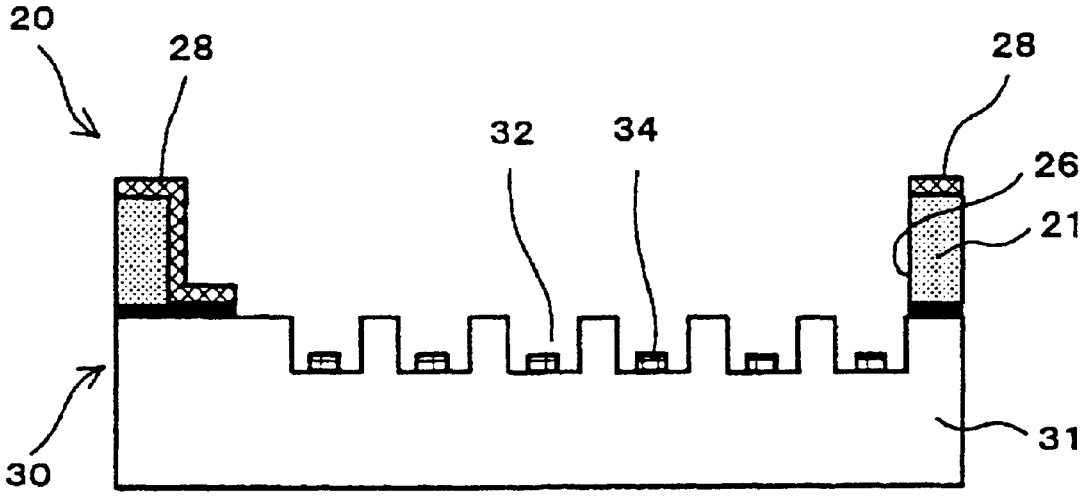
Figure 13:
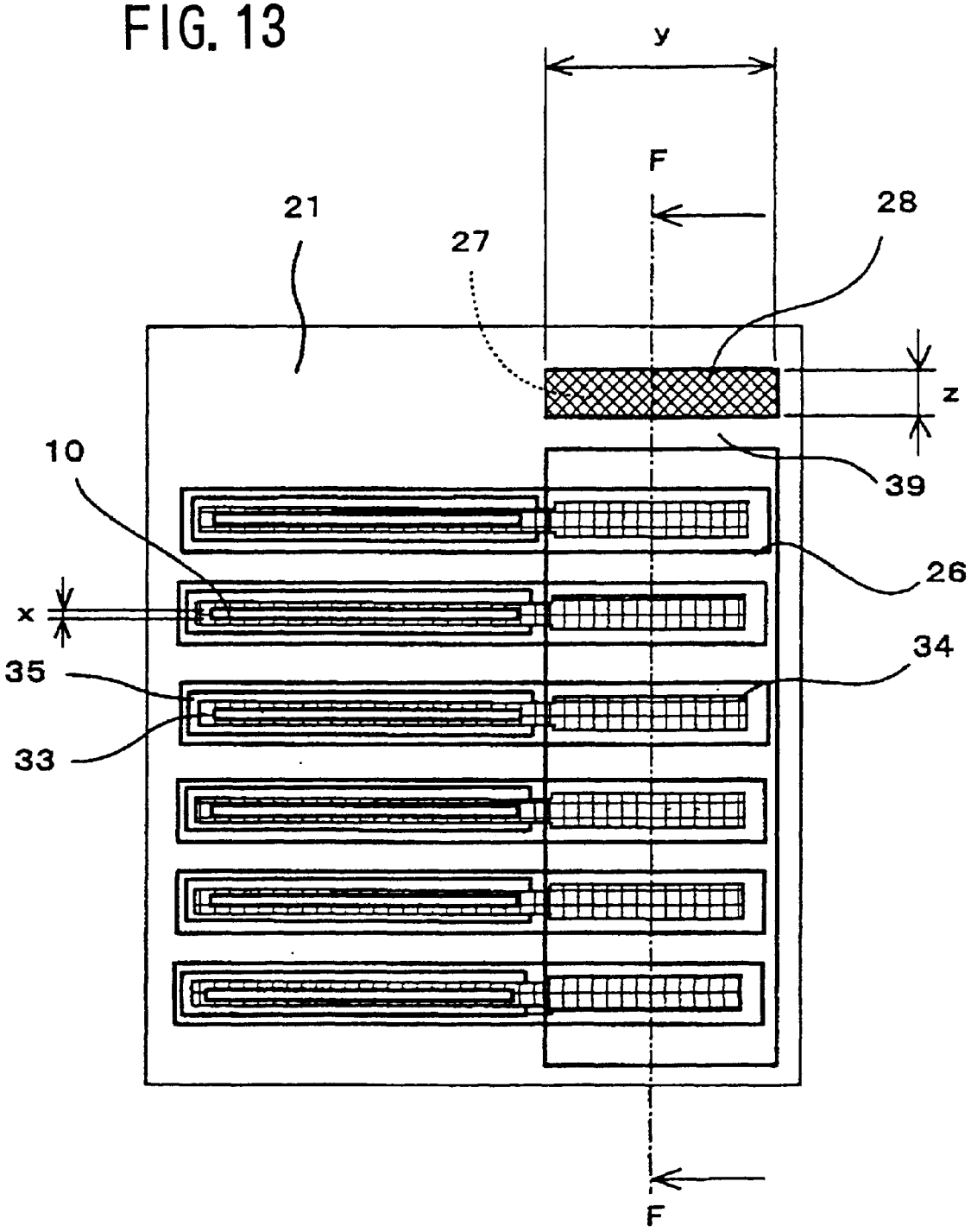
FIG. 13 is a plan view of an ink jet head of a fifth embodiment of the present invention.

Referring now to FIG. 11 and FIGS. 12A and 12B, a third embodiment of the present invention will be described below. FIG. 11 shows a plan view of the ink jet head having external electrodes formed on the diaphragm substrate. FIGS. 12A and 12B are sectional views of the ink jet head taken along the line E-E of FIG. 11, illustrating the procedures of forming the external electrodes.

In the third embodiment, a protection film (a metal film) having resistance to silicon etching is also formed on the silicon substrate including the part to be the diaphragm external electrode, before silicon etching is performed on the contact portion 26 of the diaphragm substrate 20.

More specifically, after the formation of the diaphragms 25 shown in FIG. 8B, a rinse with an HF etchant is carried out immediately before the metal film is formed. As shown in FIGS. 11 and 12A, the protection metal film 28 is formed using the deposition metal mask 37 having such a pattern that the metal film 28 covers the region of the contact portion 26 other than the region of the contact portion 26 to be removed.

As shown in FIG. 12B, the region of the contact portion 26 other than the region corresponding to the diaphragm external electrode 27 is removed by performing silicon dry etching using a gas mainly containing $SF_6$. Subsequently, the protection film ($SiO_2$ film) 35 on the individual external electrodes 34 is removed by performing $SiO_2$ dry etching using a gas mainly containing $CHF_3$, thereby uncovering the individual external electrodes 34.

In the first and second embodiments, etching is performed using the etching metal mask 36. In this embodiment, on the other hand, etching can be performed without a mask, because the entire surface of the contact portion 26 other than the region to be removed is covered with the metal film 28 made of gold having etching resistance.

In the above manner, the metal film having resistance to etching is formed on the region other than the region to be removed from the first substrate. Thus, etching can be performed without a mask. Because of the needlessness of a mask, the production costs can be reduced, and the production procedures can be simplified. Also, a yield drop due to misalignment can be restricted.

If a metallic material that has a high rigidity is employed as a material for liquid chambers to be formed on the diaphragm substrate 20, a material that can be used for eutectic bonding, pressure bonding, or soldering, is selected as the metal film having resistance to etching. Such a metallic material will simplify the diaphragm/liquid chamber bonding process and other bonding processes. Examples of the metallic material include gold, silver, and nickel. Furthermore, the region to be brought into contact with ink is covered with the metal film that is chemically stable. Accordingly, no ink erosion occurs, and good wettability can be obtained.

Next, a fourth embodiment of the present invention will be described below. In this embodiment, the etching metal mask 37 is not used, and etching is performed without a mask, as in the third embodiment.

In FIG. 9 and FIGS. 10A to 10C, each short side of each of the diaphragms 25 is denoted by x, each short side of the contact portion 26 is denoted by y, and the thickness of the silicon substrate 21 is denoted by a. When etching is performed on the contact portion 26 in the structure shown in FIG. 10B, a micro-loading effect appears due to the great thickness a (several hundreds pm) of the silicon substrate. Using an RIE (Reactive Ion Etching) apparatus, with the short side y of the contact portion 26 being variable, desirable etching was performed on 3 $\mu$m-thick silicon at an aspect ratio of 0.3 or lower, but etching was hardly effective at an aspect ratio of 0.6 or higher.

Taking the differences in etching conditions apparatuses, etching margins into account, etching can be performed without a mask, as long as the silicon substrate 21 satisfies the relationships, a/x>1 and a/y<1. An RIE apparatus normally satisfies the above relationships, but a high-density plasma etching apparatus does not satisfy those relationships.

However, a high-density plasma etching apparatus, which has been becoming common as a mass-producing apparatus, is much more expensive than a standard RIE apparatus. Accordingly, a reasonably priced standard RIE apparatus is more cost-effective. Furthermore, with an apparatus comprising a high-density plasma etching chamber and a standard RIE etching chamber, it is possible to perform etching of the diaphragms 25 by high-density plasma, and to perform etching of the contact portion by the standard RIE.

As for the diaphragm external electrode 27 formed in the contact portion 26, it is necessary to form a metal film having resistance to silicon etching, prior to the etching of the contact portion 26.

As described above, the etching of the contact portion 26 can be performed without a mask, with a structure that satisfies the relationships, a/x>1 and a/y<1, wherein x represents the short side of the opening of each of the diaphragms 25, y represents the short side of the contact portion, and a represents the thickness of the first substrate. Since a mask can be omitted, the production costs can be reduced, and the number of production steps can be decreased. Also, a yield drop due to misalignment can be restricted. Furthermore, it is possible to prevent side etching under the mask at the time of the etching of the contact portion and to avoid contamination on the bonding surface with the liquid chamber member.

Referring now to FIG. 13 and FIGS. 14A to 14D, a fifth embodiment of the present invention will be described. In this embodiment, the size of the diaphragm external electrode 27 to be formed in the contact portion 26 can be desirably controlled.

Figure 14A:
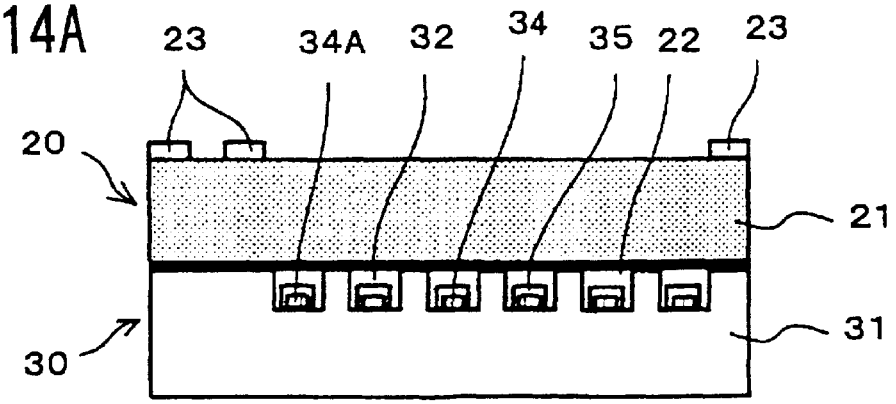
FIGS. 14A to 14D are sectional views of the ink jet head taken along the line F—F of FIG. 13, illustrating the production procedures thereof.
Figure 14B:
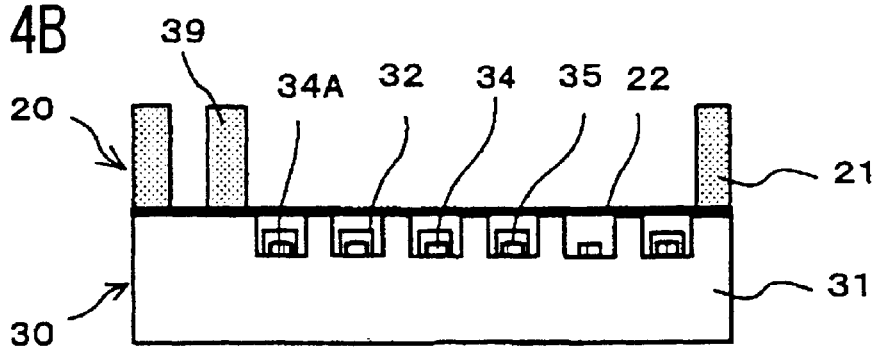

More specifically, as shown in FIG. 14A, the LPCVD-SiN film 23 as the etching mask is formed between the diaphragm external electrode 27 and the closest one of the individual external electrodes 34 to the diaphragm external electrode 27 (this individual external electrode will be hereinafter denoted by "34A"), so that no etching is performed at the time of the formation of the diaphragms 25. As shown in FIG. 14B, etching is then performed on the diaphragm silicon substrate 21 to form the diaphragms 25 and the contact portion 26. Here, a silicon pillar 39 is created between the diaphragm external electrode 27 and the closest individual external electrode 34A.

Figure 14C:
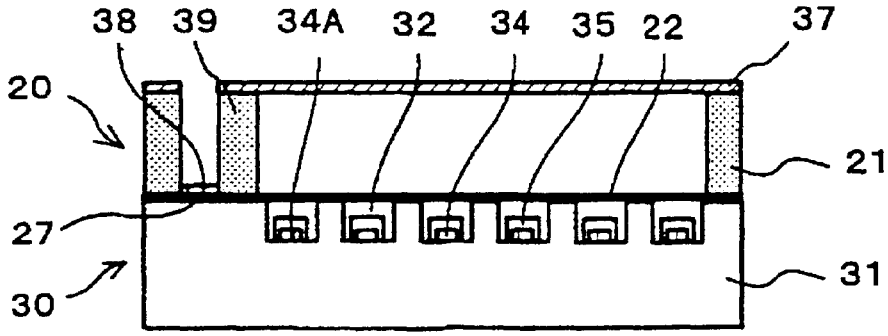
Figure 14D:
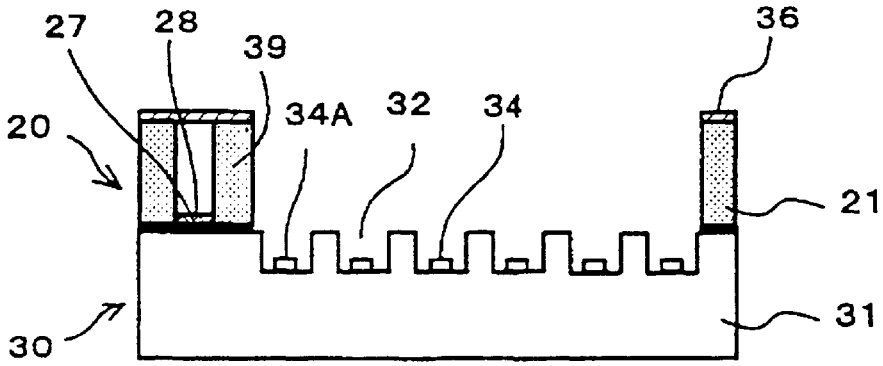
Figure 15:
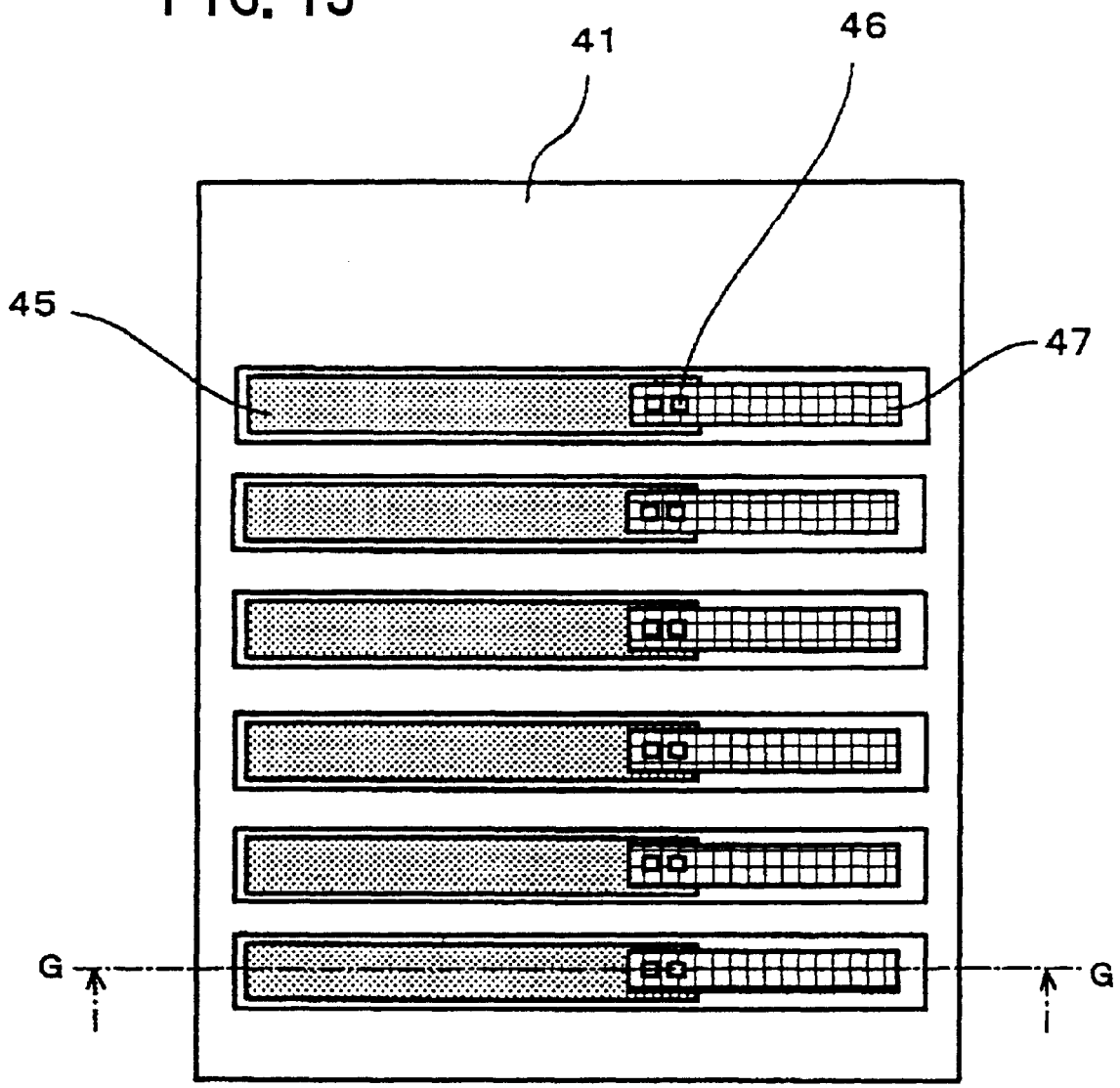
FIG. 15 is a plan view of an ink jet head of a sixth embodiment of the present invention.

As shown in FIG. 14C, with the deposition metal mask 37, a metal film 28 made of gold, for instance, is deposited on the part to become the diaphragm external electrode 27. As shown in FIG. 14D, with the etching mask 36, the silicon on the contact portion 26 and the $SiO_2$ films 35 on the individual external electrodes 34 are removed.

In the above manner, with the silicon pillar 39 between the diaphragm external electrode 27 and the closest individual external electrode 34A, the diaphragm external electrode 27 can be accurately formed. In the foregoing embodiments, the silicon pillar 39 is created between the diaphragm external electrode 27 and the closest individual external electrode 34A. As a result, the side of the gold film 28 formed on the diaphragm external electrode becomes too large for the deposition metal mask 37.

If the gold film 28 expands onto the closest individual external electrode 34A, silicon penetration cannot be performed on the closest individual external electrode 34A, resulting in unavailability of the closest individual external electrode 34A. Also, if the gold film 28 is to be allowed to expand, it is necessary to ensure wide space between the diaphragm external electrode 27 and the closest individual external electrode 34A. As a result, the area of the entire ink jet head becomes too large. To compensate the expansion of the gold film 28, the mask needs to be designed to be small enough to accommodate the expansion. However, the deposition rate becomes lower with a smaller mask, resulting in more time-consuming film formation.

In this embodiment, on the other hand, the gold film 28 having a desired size (size equal to the size of the mask) can be formed on the diaphragm external electrode 27, without changing the size of the mask. Also, wider etching margins can be allowed for silicon dry etching using the etching metal mask 36.

As described above, the part between the diaphragm external electrode 27 and the closest individual external electrode 34A is maintained, so that the adhesion of the mask at the time of the formation of the metal film 28 on the diaphragm external electrode 27 or at the time of etching can be improved. Thus, the side of the diaphragm external electrode 27 can be desirably controlled.

In this case, etching can be performed without a mask, as long as the diaphragm silicon substrate 21 satisfies the relationships, a/x>1, a/z>1, and a/y<1, wherein x represents a short side of each of the diaphragms 25, y represents a short side of the contact portion 26, z represents a short side of the diaphragm external electrode 27, and a represents the thickness of the diaphragm silicon substrate 21. As long as the above relationships are satisfied, the diaphragm external electrode 27 can be maintained without having the gold film 28 formed on the diaphragm external electrode 27.

In the above manner, two masks can be omitted from the ink jet head. Accordingly, the production costs can be reduced, and the number of production steps can be decreased. Furthermore, a decrease in yield due to misalignment can be effectively restricted. However, the existence of the silicon pillar 39 might hinder the pressure bonding of the FPC and the like. Still, the advantages of the silicon pillar 39 are much greater than the drawback.

Referring now to FIG. 15 and FIGS. 16A to 16E, a sixth embodiment of the present invention will be described. In this embodiment, a silicon substrate is used as an electrode substrate, and n-type or p-type impurity layer is formed as an electrode. The diaphragm silicon substrate of this embodiment is produced in the same manner as in the foregoing embodiments.

Figure 16A:
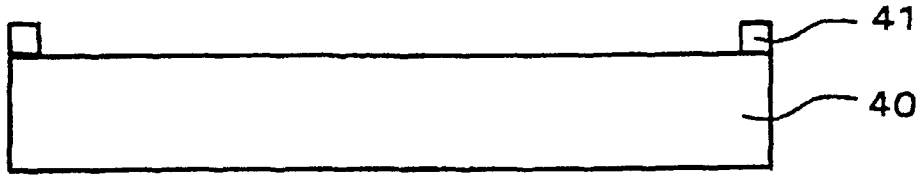
FIGS. 16A to 16E are sectional views of the ink jet head taken along the line G—G of FIG. 15, illustrating the production procedures thereof.
Figure 16B:
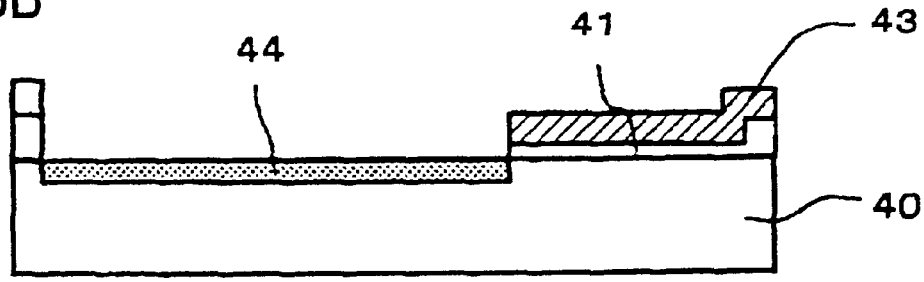

As shown in FIG. 16A, a 0.5 $\mu$m-thick $SiO_2$ film 41 to be a gap spacer is formed on a silicon substrate 40 by a thermal oxide film forming technique, followed by patterning. As shown in FIG. 16B, a 0.2 $\mu$m-thick $SiO_2$ film 42 to be a support member for a metal member to be formed on the contact portion 26 of the diaphragm substrate. The part of the $SiO_2$ film 42 corresponding to the impurity layer is patterned by a photoresist 43, and then removed. Subsequently, phosphorus, for instance, is injected so as to form an n-type impurity layer 44 (or a p-type impurity layer 44).

Figure 16C:
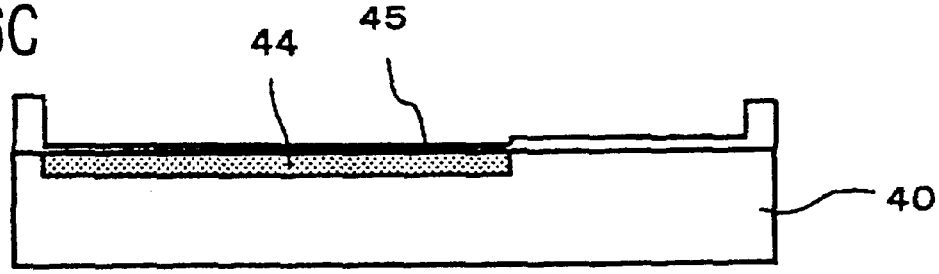
Figure 16D:
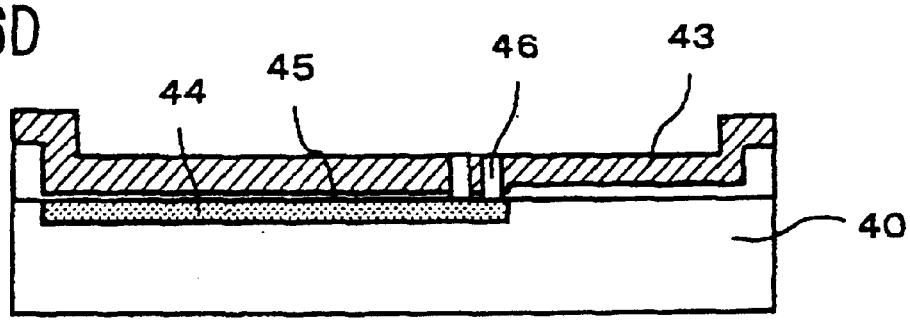
Figure 16E:
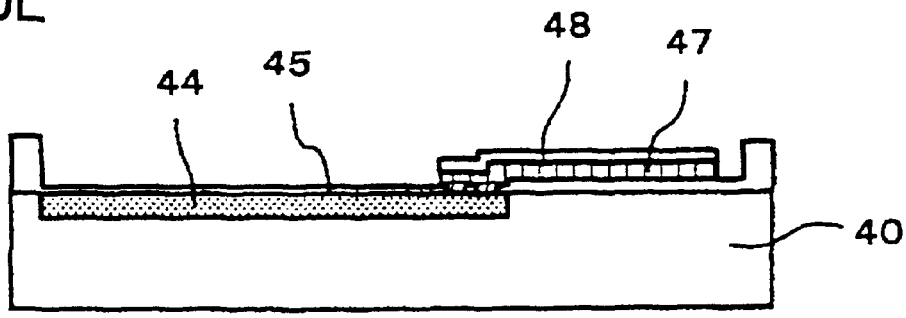

As shown in FIG. 16C, a 0.1 $\mu$m-thick $SiO_2$ film 45 to be a protection film is formed to activate the n-type impurity layer 44. As shown in FIG. 16D, a connecting hole 46 is then formed at a desired location in the n-type impurity layer 44. As shown in FIG. 16E, a metal film 47 is further formed. Taking into account the fact that direct boding is to be carried out at 800° C. afterward, the metal film 47 is preferably a TiN film having high heat resistance. Subsequently, a $SiO_2$ film 48 is formed by a plasma CVD technique, and the $SiO_2$ film 48 and the TiN film 47 is patterned.

The PCVD-$SiO_2$ film 48 serves as an etching cover film at the time of the etching of the contact portion 26. It is easy to form narrow gaps with high precision on the silicon substrate electrode having the impurity diffusion layer as an electrode. Also, the silicon substrate electrode is provided with the high-quality electrode protection film. Thus, an electrode substrate having high reliability and high yield can be obtained.

Figure 17:
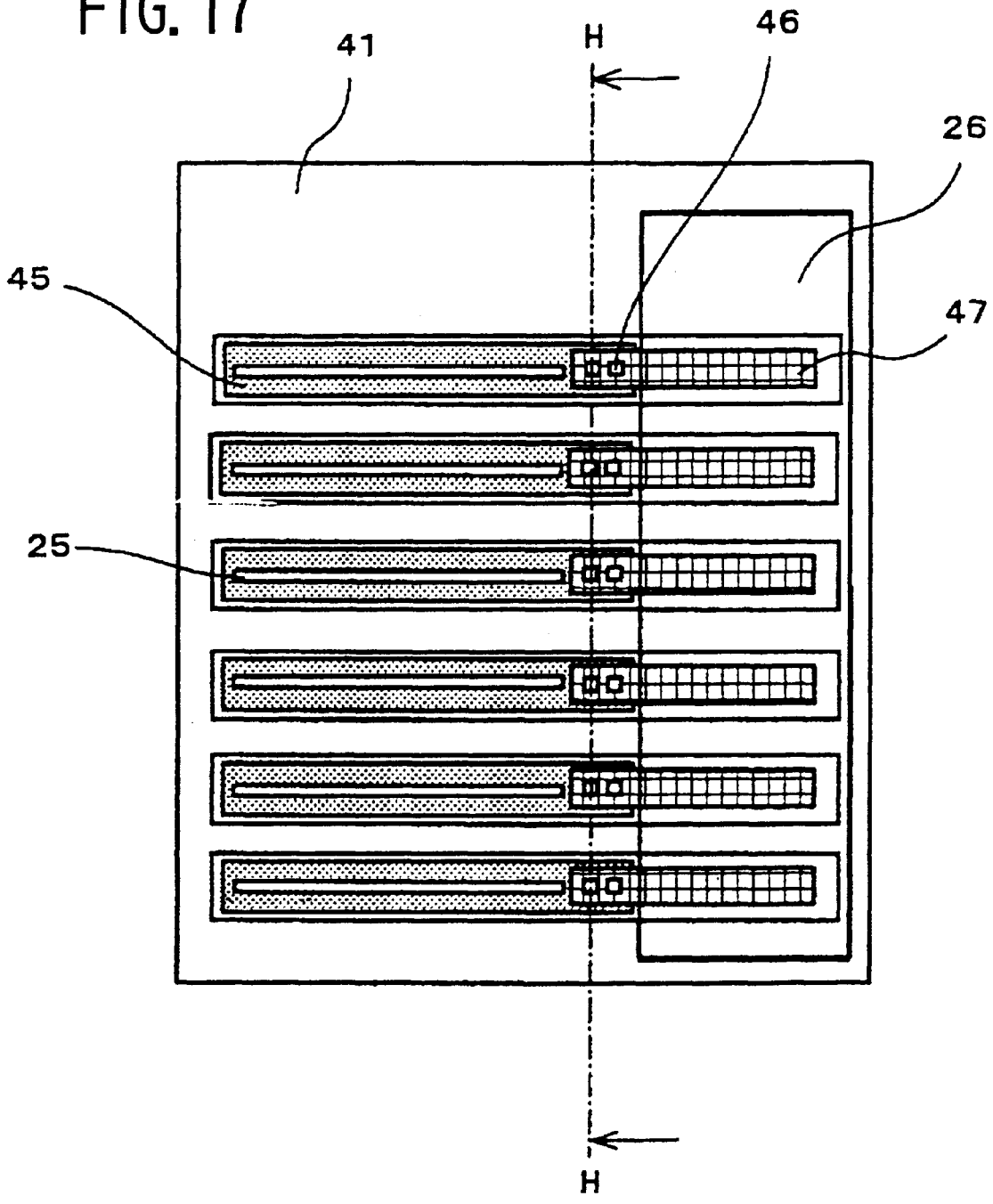
FIG. 17 is a plan view of an ink jet head of a seventh embodiment of the present invention.
Figure 18A:
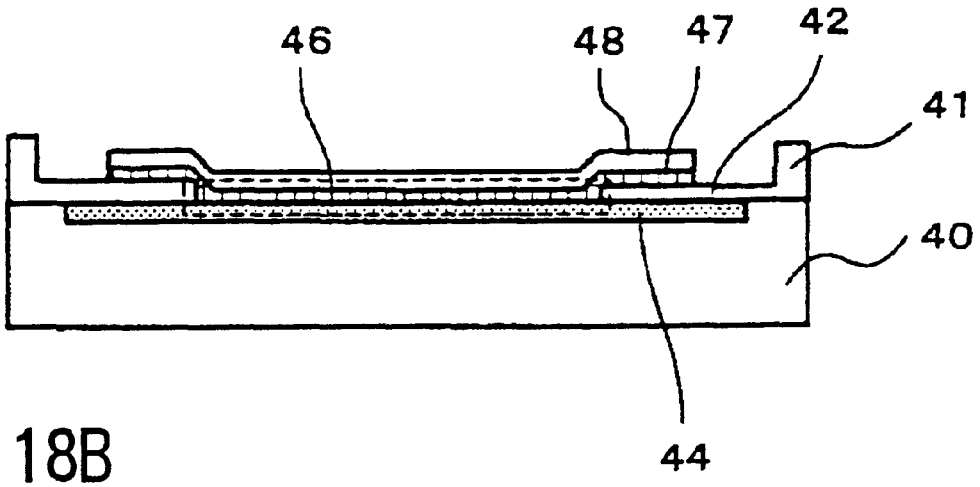
FIGS. 18A and 18B are sectional view of the ink jet head taken along the line H—H of FIG. 17, illustrating the production procedures thereof.
Figure 18B:
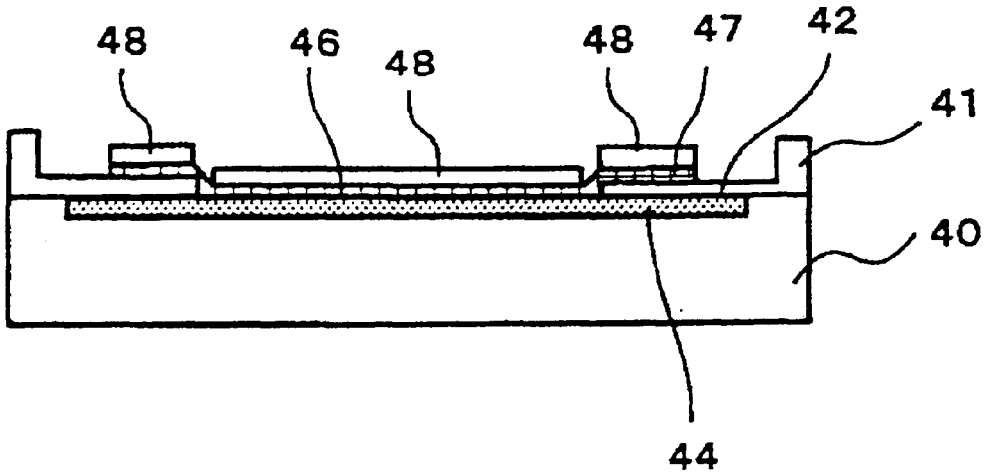

However, there is a drawback in this embodiment. Referring now to FIG. 17 and FIGS. 18A and 18B, the disadvantage of this embodiment will be described.

As shown in FIG. 18A, there are differences in height around the connecting hole 46. Accordingly, the entire surface is not well covered, and the TiN film 47 and the PCVD-$SiO_2$ film 48 are thin. Particularly, the PCVD-$SiO_2$ film 48 might have many minute pinholes and film deterioration at the stepped portions, because it is not so dense as a thermal oxide film. When the substrates are rinsed with water containing excess ammonia or a sulfuric acid solution before the direct bonding, the PCVD-$SiO_2$ film 48 is slightly etched. If worse, the parts of the PCVD-$SiO_2$ film 48 at the stepped portions might be completely removed.

If the PCVD-$SiO_2$ film 48 is partially removed on the contact portion, of the diaphragm substrate, the n-type impurity layer, as well as the TiN film 47, will be etched at the time of the silicon etching of the contact portion 26. In such a situation, bonding leak becomes to large for the n-type impurity layer 44 to function as an electrode.

To avoid such a problem, only the n-type impurity layer 44 is formed on the parts adjacent to the diaphragms 15, and only the sheet-type TiN film 47 is formed on the contact portion 26, as shown in FIG. 17. With this structure, the connecting hole 46 for the n-type impurity layer 44 and the TiN film 47 is formed between each of the diaphragms 25 and the contact portion 26. Thus, the above problem can be eliminated.

In the above manner, the p-type or n-type impurity layer 44 is formed on the parts adjacent to the diaphragms, and a sheet-type heat resistant film is formed on the contact portion 26, so that the connecting hole for the impurity layer 44 and the metal film 47 is located between the diaphragms 25 and the contact portion 26. With this structure, over-etching of the silicon substrate can be prevented at the time of the etching of the contact portion 26, and the reliability of the electrode substrate can be increased.

Figure 19:
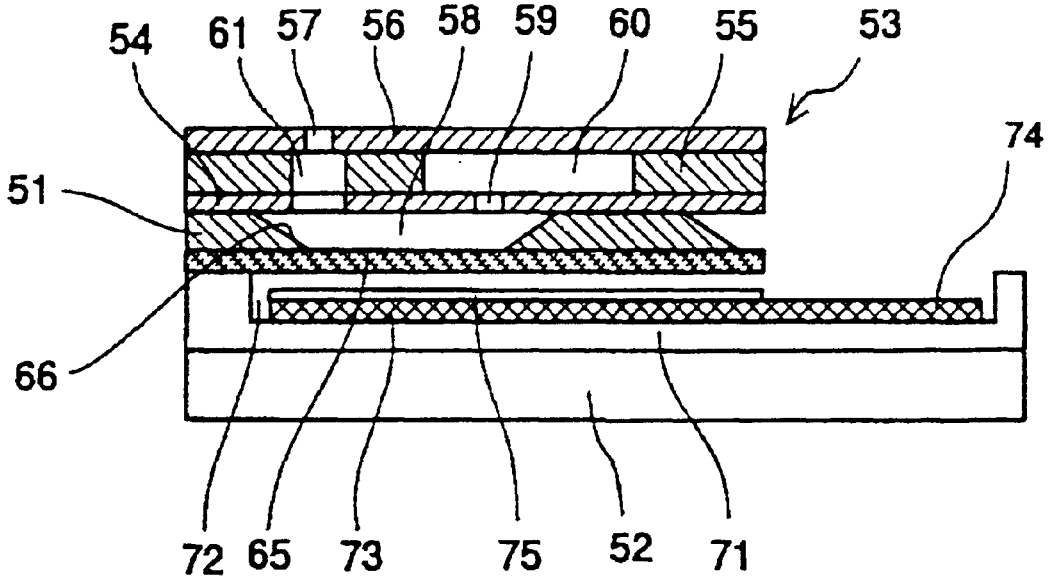
FIG. 19 is a sectional view of an ink jet head of a modification of the present invention taken along the line I—I of FIG. 21.
Figure 20:
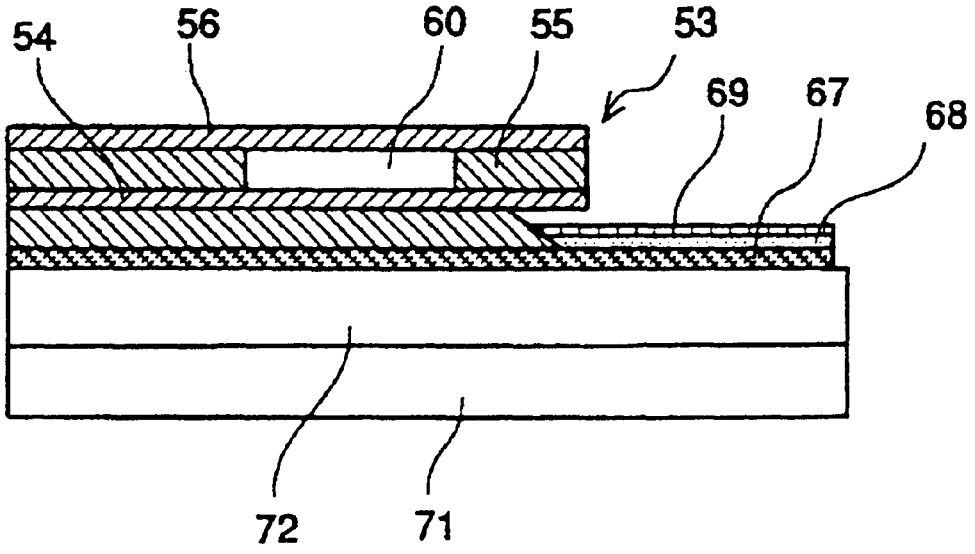
FIG. 20 is a sectional view of the ink jet head taken along the line J—J of FIG. 21.
Figure 21:
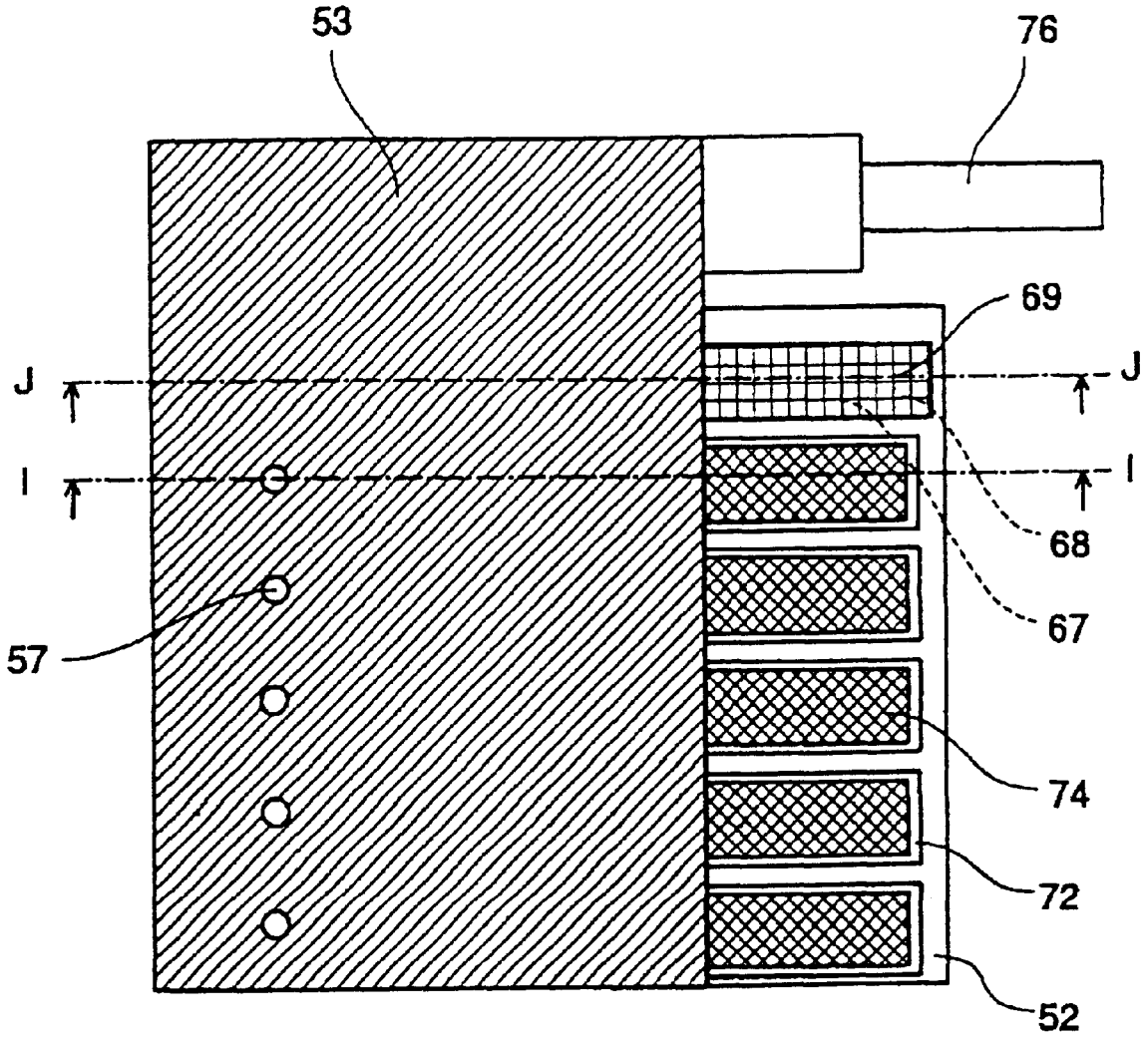
FIG. 21 is a plan view of the ink jet head.
Figure 22:
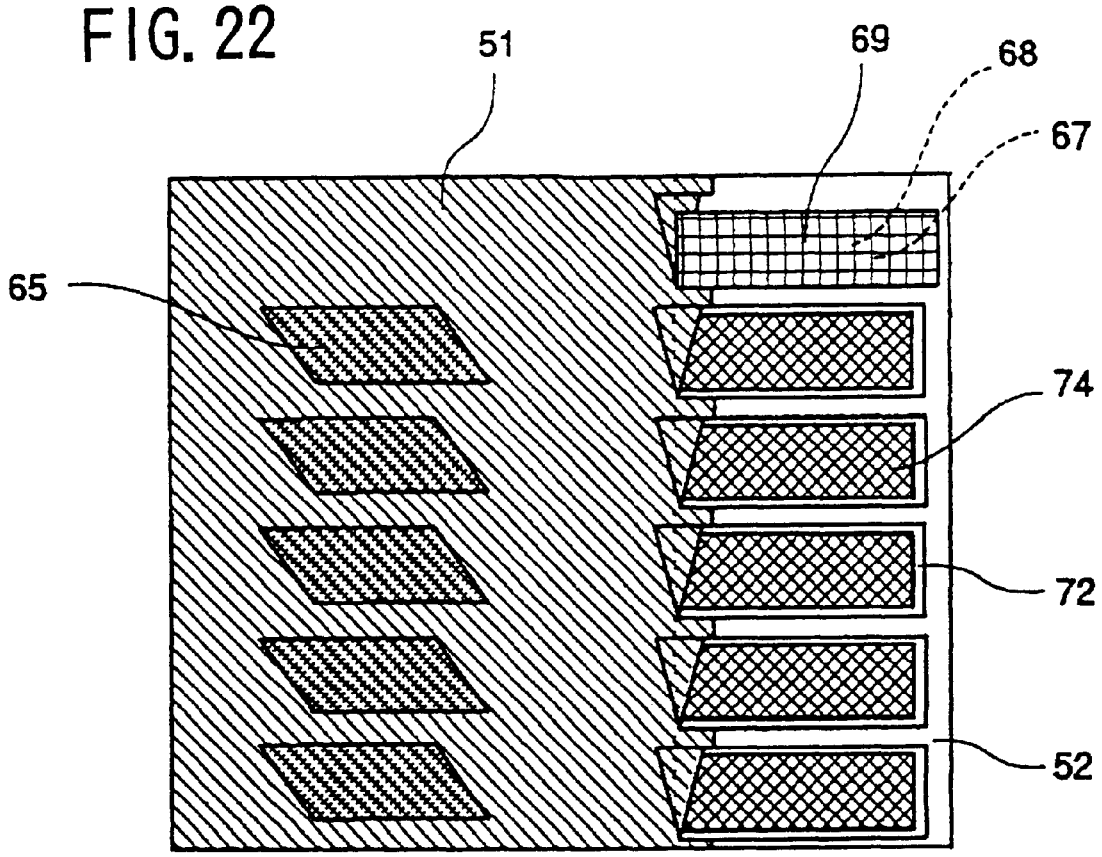
FIG. 22 is a plan view of the ink jet head of FIG. 21 without a nozzle unit.

Referring now to FIGS. 19 to 22, a modification of a modification of the ink jet head of the present invention will be described. FIG. 21 is a plan view of the ink jet head in accordance with this modification. FIG. 19 is a sectional view of the ink jet head taken along the line I—I of FIG. 21. FIG. 20 is a sectional view of the ink jet head taken along the line J—J of FIG. 21. FIG. 22 is a plan view of the ink jet head of FIG. 21, with a nozzle unit being removed.

This ink jet head comprises: a diaphragm/liquid chamber substrate 51 that is a first substrate formed by a silicon substrate, such as a monocrystal silicon substrate, a polycrystal silicon substrate, or an SOI substrate; an electrode substrate that is a second substrate formed by a silicon substrate disposed under the diaphragm/liquid chamber substrate 51; and a nozzle unit 53 formed above the diaphragm/liquid chamber substrate 51. The nozzle unit 53 comprises a fluid passage forming plate 54, a common ink chamber forming plate 55, and a nozzle plate 56. The nozzle unit 53 forms a plurality of nozzle holes 57, discharging chambers 58 that serve as link passages communicating with the nozzle holes 57, a common ink chamber 60 communicating with the discharging chambers 58 via a fluid resistance unit 59 that also serves as ink supply passages, and nozzle connecting passages 61 connecting the nozzle holes 57 and the discharging chambers to the common ink chamber 60.

The diaphragm/liquid chamber substrate 51 has concave portions 66 to form diaphragms (first electrodes) 65 that are the wall surfaces of the discharging chambers 58. A diaphragm external electrode (a common electrode pad) 67 is disposed on the same plane as the diaphragms 65. If a monocrystal silicon substrate is used as the diaphragm/liquid chamber substrate 15, boron is injected to form a high-concentration boron layer that serves as an etching stopper layer. After the diaphragm/liquid chamber substrate 51 is bonded to the electrode substrate 52, anisotropic etching using an etchant such as a KOH solution is performed on the concave portions 66. Here, the high-concentration boron layer serves as the etching stopper layer, so that the diaphragms 65 and the diaphragm external electrode 67 can be formed. The diaphragm external electrode (the common electrode pad) 67 is made up of layers such as the high-concentration boron layer injected and diffused into the silicon substrate 51 and having the same thickness as each of the diaphragms 65. A first metal layer 68 is formed on the upper surface of the diaphragm external electrode 67, and a second metal layer 69 is formed on the first metal layer 68.

The first metal layer 68, which is the lowermost layer in contact with the silicon, is formed by a metallic material having ohmic contact ability, such as Al, Ti, or Au. The second metal layer 69, which is the outermost layer, is made of a material, such as Al, Ni, Pt. Au, or TiN, having resistance to silicon or $SiO_2$ reactive ion etching. It is more preferable to use Au or Pt for the second metal layer 69, because Au and Pt have resistance to halogen contained in a solvent of an organic coating film used in packaging. The metal layer structure can be a 1-layer structure or a three-layer structure, instead of the 2-layer structure.

Meanwhile, a $SiO_2$ film 71 to be a gap spacer is formed on the electrode substrate 52. Electrodes 73 are then formed on the bottom surfaces of concave portions (gaps) 72 formed in the $SiO_2$ film 71. The electrodes 73 are extended to integrally form individual external electrodes (individual electrode pads) 74. An insulating protection film (a passivation oxide film) 75 to protect the electrodes is formed on the electrodes 73.

In this structure, the common electrode pad (the diaphragm external electrode) 67 disposed on the same plane as the diaphragms 65 is located within 2 $\mu$m from the individual electrode pads (the individual external electrodes) 74 formed on the bottom surfaces of the gaps 72 of the electrode substrate 52. Also, the common electrode pad 67 and the individual electrode pads 74 are aligned. It is more preferable to restrict the vertical-direction distance between the individual electrode pads 74 and the common electrode pads 67 including the metal layers 68 and 69 within 2 $\mu$m.

The fluid passage forming plate 54 of the nozzle unit 53 is provided with through holes that form the ink supply passages 59 and through holes that form the nozzle connecting passages 61. The common ink chamber forming plate 55 is provided with through holes that form the common ink chamber 60 and through holes that form the nozzle connecting passages 61. The nozzle plate 56 is provided with the nozzle holes 57. Water-repellent finishing is performed on the surface of the nozzle plate 56. The nozzle unit 53 also includes an ink supply inlet 76 for supplying ink from the outside into the common ink chamber 60.

As described above, the diaphragm external electrode 67 is disposed on the same plane as the diaphragms, so that the vertical-direction distance between the diaphragm external electrode 67 and the individual external electrodes 74 can be made shorter. As the diaphragm external electrode 67 and the individual external electrodes 74 are arranged within the small distance, the diaphragms 65 and the electrodes 73 can be easily connected to an external circuit by a connector including lead wires such as FPC. It is particularly preferable to restrict the distance between the diaphragm external electrode 67 and the individual external electrodes 74 within 2 $\mu$m, so that the diaphragms 65 and the electrodes 73 can be easily connected to an external circuit by a connector including lead wires such as FPC.

Also, since the diaphragm external electrode 67 and the individual external electrodes 73 are all aligned, so that the diaphragm external electrode 67 and the individual external electrodes 73 can be collectively connected by a connector. This simplifies the connecting process, and there is no need to employ a special-purpose connector as in the prior art. Thus, an increase in production cost can be prevented.

In this modification, the diaphragms 65 and the diaphragm external electrode 67 are formed on the first substrate, and the metal layers are formed on the diaphragm external electrode 67, so that the diaphragm external electrode 67 can be formed by etching as well as the diaphragms 65. Also, the resistance at the time of packaging can be increased. As the metal layers on the diaphragm external electrode 67 has a multi-layered structure, both etching resistance and packaging resistance can be obtained at the same time. Here, a metallic material having ohmic contact ability with silicon is used for the innermost layer in contact with the first substrate, so that the contact resistance can be reduced. Also, a metallic material having resistance to a halogen-type etchant is used for the outermost layer of the metal layers, so that etching resistance can be obtained while the production cost is reduced.

Next, the production procedures of the ink jet head will be described below. In the drawings (FIGS. 23A to 30C), only the region in the vicinity of the diaphragm external electrode is shown.

Figure 23A:
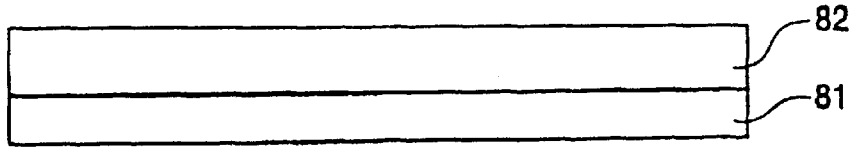
FIGS. 23A to 23E are sectional views of the ink jet head of FIG. 21, illustrating the procedures up to the bonding step of a diaphragm/liquid chamber substrate and an electrode substrate.

Referring now to FIGS. 23A to 23E, the procedures of bonding the diaphragm/liquid chamber substrate 51 and the electrode substrate 52 will be described. As shown in FIG. 23A, a thermal oxide film 82 to be a gap spacer having a thickness of 2 $\mu$m, for instance, is formed on a monocrystal silicon wafer 81 that is to become the electrode substrate 52 by a wet oxidation process or the like.

Figure 23B:
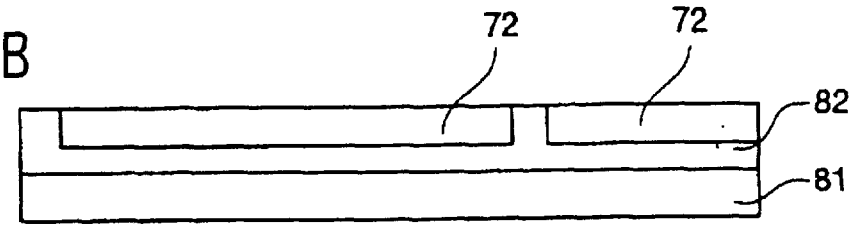
Figure 23C:
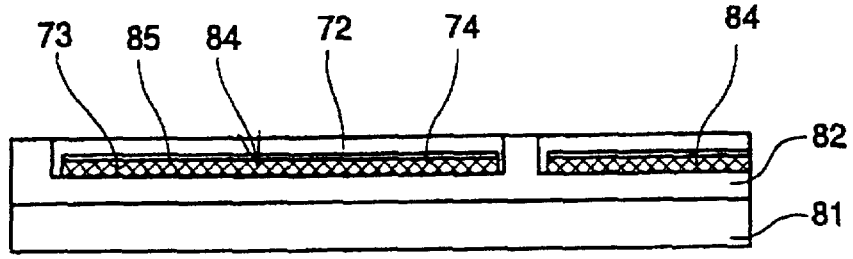

As shown in FIG. 23B, an organic resist film is patterned by a photolithography technique, and the oxide film 82 is etched with buffering hydrofluoric acid, thereby forming the concave portions (gaps) 72. Subsequently, a TiN film is formed by sputtering Ar containing $N_2$ onto a Ti target, and an oxide film is formed on the TiN film by a plasma CVD technique. The organic resist is patterned by a photolithography technique, followed by etching of the oxide film and ashing. Etching is further performed using the mixture of hydrogen peroxide and ammonia so as to form TiN electrodes 84 to be the electrodes 73 and the individual external electrode 74, which are then covered by an oxide film 85 that is an insulating protection film, as shown in FIG. 23C.

Figure 23D:
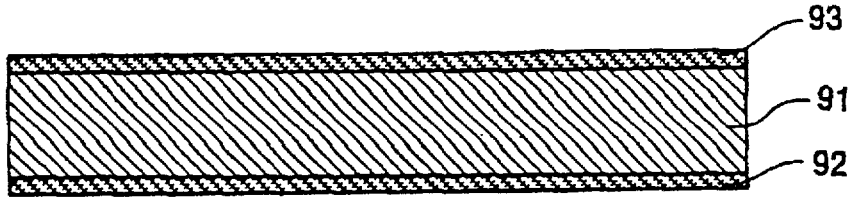

Meanwhile, as shown in FIG. 23D, boron diffusion layers 92 and 93 are formed on a monocrystal silicon wafer 91 of plane orientation (110) to be the diaphragm/liquid chamber substrate 51 by diffusing high-concentration boron (more than 1E20 $cm^{-3}$) at a depth corresponding to the thickness of each of the diaphragms 54. An SOI wafer having an active layer including n-type donor impurities corresponding to the thickness of each of the diaphragms 65 may be used as the diaphragm/liquid chamber substrate 51.

Figure 23E:
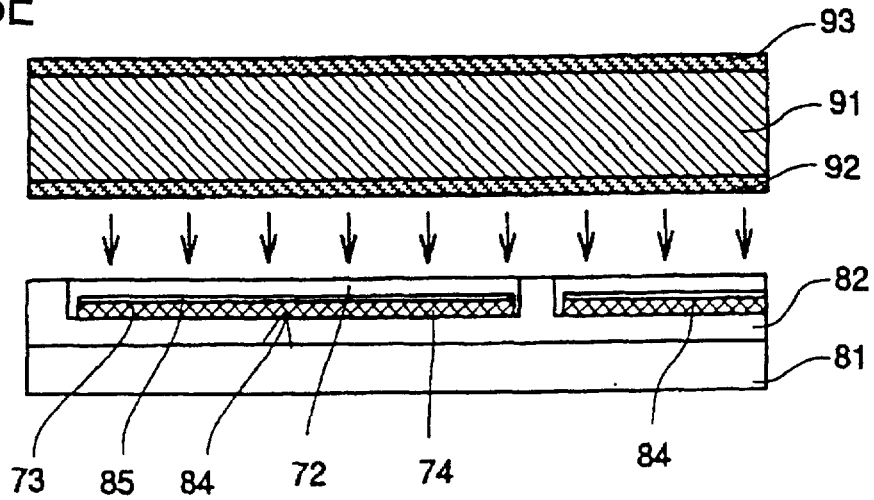

As shown in FIG. 23E, the silicon wafer 91 is overlapped on the silicon wafer 81 in a vacuum. The silicon wafers 81 and 91 are than heated, so that the silicon wafers 81 and 91 are bonded directly to each other.

Next, the procedures after the direction bonding up to the formation of the external electrodes will be described below.

Figure 24:
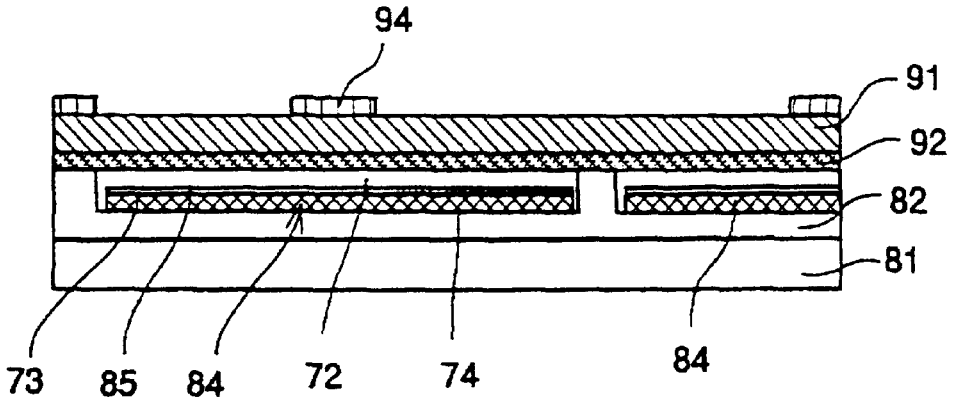
FIG. 24 is a sectional view illustrating the procedures after the bonding step until the formation of external electrodes.

First, as shown in FIG. 24, the silicon wafer 91 is ground to a thickness equivalent to the thickness of the diaphragm/liquid chamber substrate 51 (80 $\mu$m, for instance). A SiN film is then formed by a thermal CVD technique, and patterned by a photolithography technique, thereby forming a SiN film mask 94.

Figure 25A:
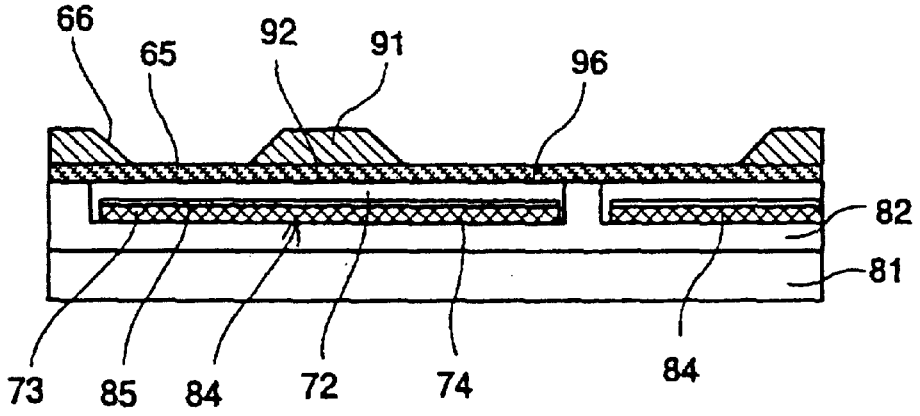
FIG. 25A is a sectional view of the ink jet head taken along the line K—K of FIG. 25B.
Figure 25B:
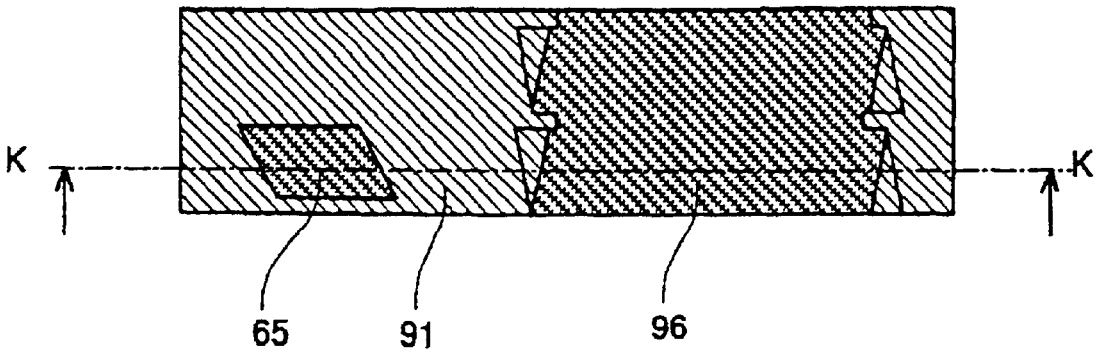
FIG. 25B is a plan view of the ink jet head.

Subsequently, silicon anisotropic etching using a KOH solution is performed. As shown in FIG. 25A, the etching rate drastically drops on the high-concentration boron layer 92, thereby forming the discharging concave portions 66, a contact portion 96 that is to form the diaphragms 65 defined by the thickness of the high-concentration boron layer 92 and the diaphragm external electrode 67. If an SOI wafer is employed, the silicon etching is stopped on the oxide film, thereby forming the diaphragms 65 and the contact portion 96.

Figure 26A:
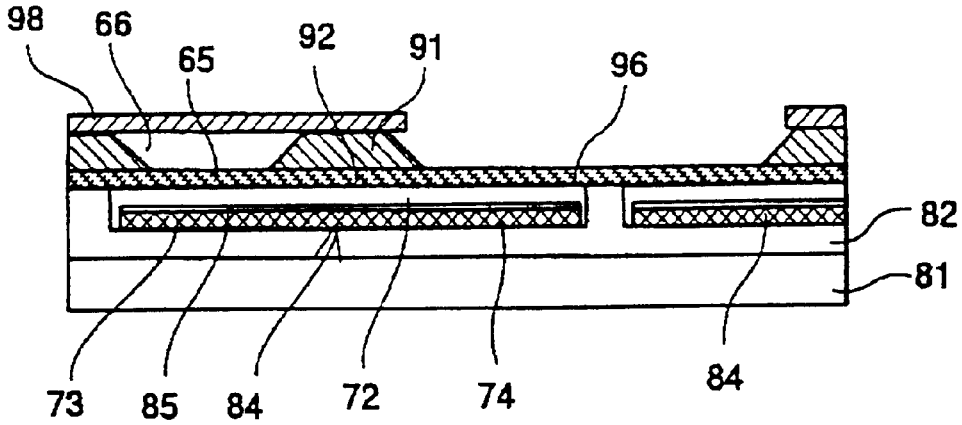
FIG. 26A is a sectional view of the ink jet head taken along the line L—L of FIG. 26B.
Figure 26B:
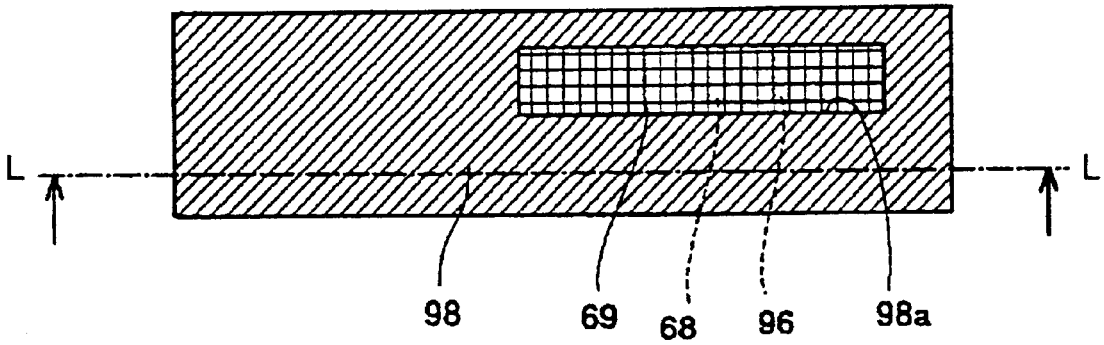
FIG. 26B is a plan view of the ink jet head.

The metal layers are then formed on the part of the contact portion 96 to be the diaphragm external electrode 67, using a multi-target sputtering apparatus or a multi-source vapor deposition apparatus. As shown in FIGS. 26A and 26B, a metal mask 98 having an opening 98a corresponding to the diaphragm external electrode of an adjacent chip is formed on the silicon wafer 91, and the first metal layer 68 is then formed. Since the first metal layer 68 is brought into contact with the high-concentration boron layer 92 on the silicon wafer 91, a metallic material having ohmic contact ability, such as Al, Ti, or Au, is used for the first metal layer 68.

The second metal layer 69 is then formed on the first metal layer 68. For the second metal layer 69, a material having resistance to silicon or $SiO_2$ reactive ion etching, such as Al, Ni, Pt, Au, or TiN, is used. More preferably, a material, such as Au or Pt, having resistance to etching by halogen contained in a solvent of an organic coating film used in packaging should be used for the second metal layer 69.

With the multi metal layer structure, the amount of use of noble metals that are 50 to 100 times as expensive as general metals can be reduced, while ohmic contact with silicon can be achieved. For instance, Ni excels in durability, but does not have ohmic contact with silicon. Therefore, a metal having ohmic contact ability with silicon is brought into contact with silicon. Thus, the outermost layer can be formed by an inexpensive metal.

Figure 27A:
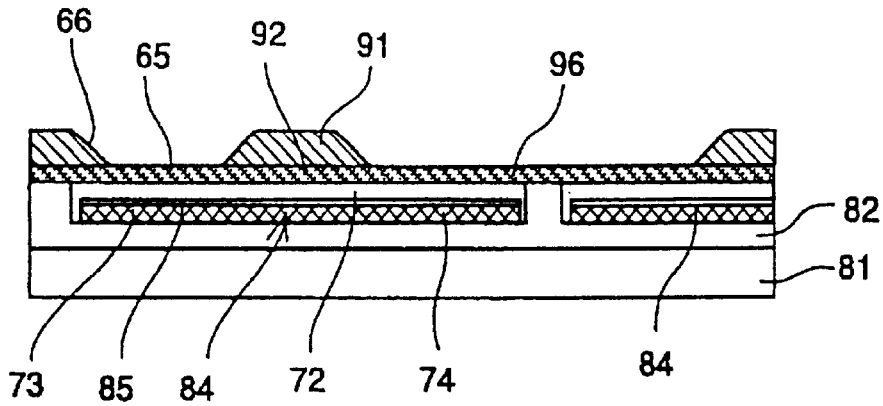
FIG. 27A is a sectional view of the ink jet head taken along the line M—M of FIG. 27C.
Figure 27B:
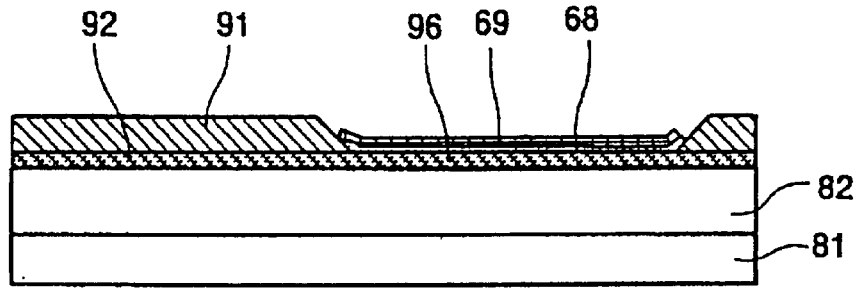
FIG. 27B is a sectional view of the ink jet head taken along the line N—N of FIG. 27C.
Figure 27C:
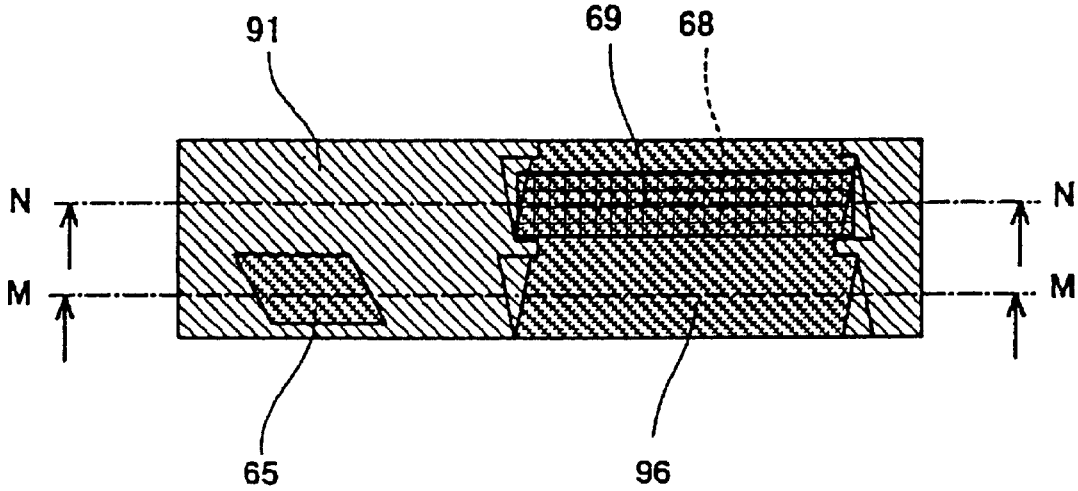
FIG. 27C is a plan view of the ink jet head.

The metal mask 98 is then removed, so that the first metal layer 68 and the second metal layer 69 are formed on the part of the contact portion 96 to be the diaphragm external electrode 67, as shown in FIGS. 27B and 27C, and that the regions corresponding to the individual external electrodes 74 remain covered with the contact portion 96.

Referring now to FIGS. 28A to 30C, the procedures of dividing into head chips and forming the individual external electrodes.

Figure 28A:
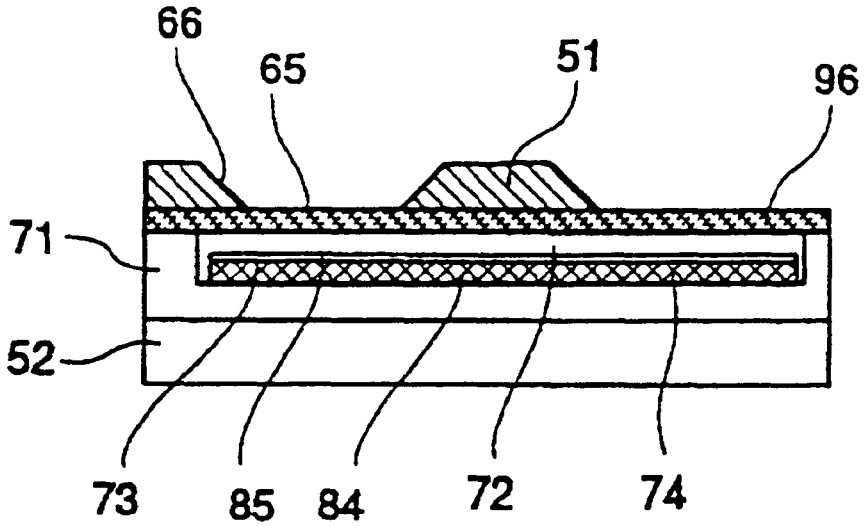
FIG. 28A is a sectional view of the ink jet head taken along the line O—O of FIG. 28B, illustrating the procedures from the dividing step into chips until the formation of individual external electrodes.
Figure 28B:
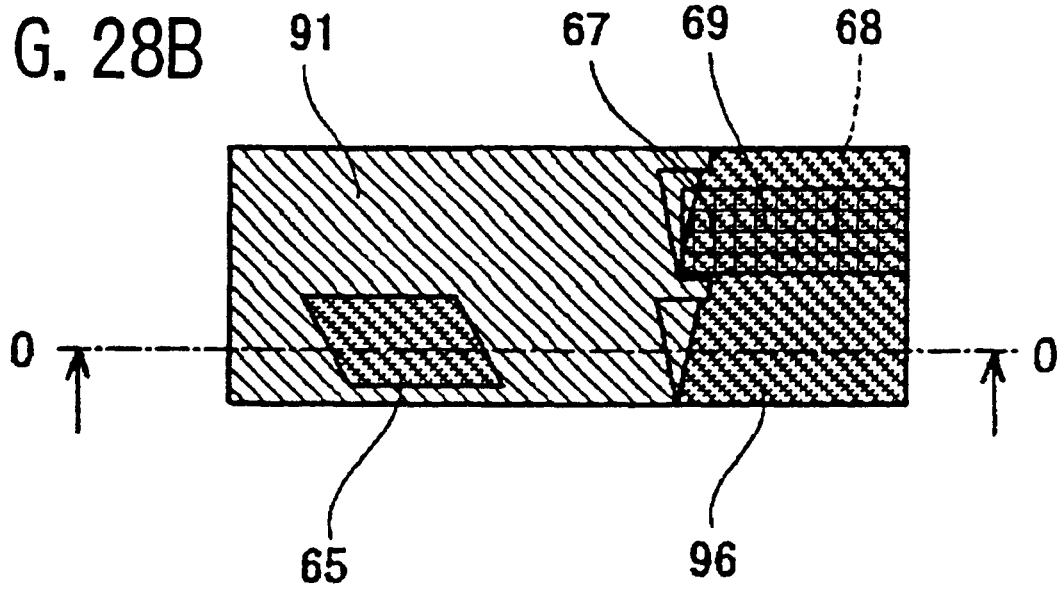
FIG. 28B is a plan view of the ink jet head.

First, the silicon wafers 81 and 91 bonded to each other is diced into individual head chips, as shown FIGS. 28A and 28B, thereby obtaining head chips each having the diaphragm/liquid chamber substrate 51 formed from the silicon wafer 91 and the electrode substrate 52 formed from the silicon wafer 81 bonded to each other.

At this point, the diaphragm/liquid chamber substrate 51 is provided with the diaphragms 65, the concave portions 66, the contact portion 96, and the first and second metal layers 68 and 69 formed on the part of the contact portion 96 to be the diaphragm external electrode (the common electrode pad) 67. Meanwhile, the electrode substrate 52 is provided with the electrodes 73 and the individual external electrodes (the individual electrode pads) 74. Here, the individual external electrodes (the individual electrode pads) 74 of the electrode substrate 52 is covered with the contact portion 96 of the diaphragm/liquid chamber substrate 51.

In the above manner, the silicon wafers are divided into a plurality of head chips. Thus, the production costs can be reduced. Generally, water or some other liquid material is used for cooling a blade used for dicing the silicon wafers into chips. If the regions corresponding to the individual external electrodes 74 are opened prior to the dicing, the cooling water might enter into the gaps 72, resulting in the bonding of the diaphragms 65 to the electrodes 73. To eliminate such a problem, the silicon wafers are diced into individual head chips before the regions of the contact portion 96 corresponding to the individual external electrodes 74 are opened.

Figure 29A:
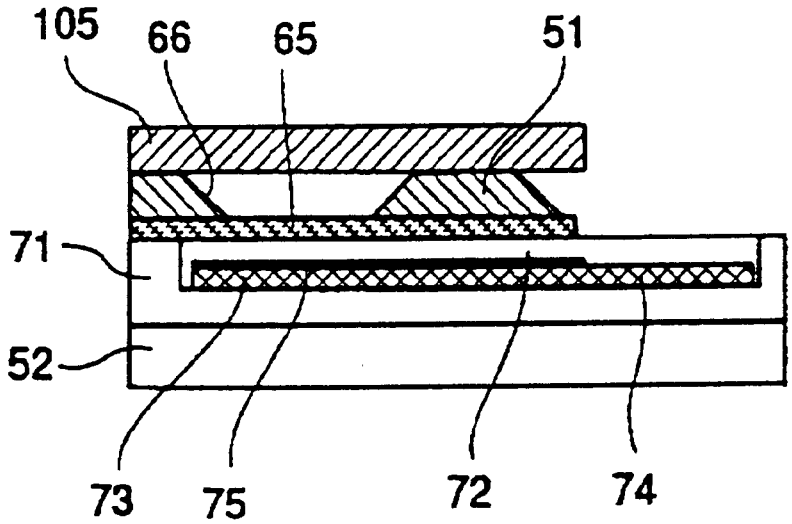
FIG. 29A is a sectional view of the ink jet head taken along the line P—P of FIG. 29B.
Figure 29B:
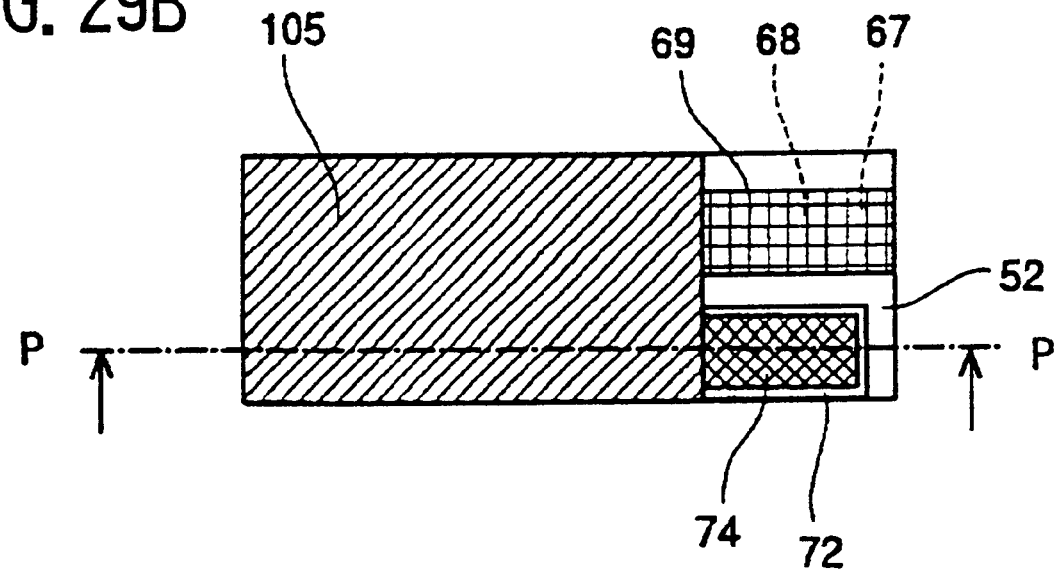
FIG. 29B is a plan view of the ink jet head.

After that, as shown in FIGS. 29A and 29B, an etching jig (an etching mask) 105 is attached onto the diaphragm/liquid chamber substrate 51. The etching mask 105 is made of a material, such as quartz or alumina, which does not generate a reaction product due to etching. The RIE of silicon is then etched by a halogen-containing gas such as a mixed gas containing $SF_6$, so that the regions of the contact portion 96 corresponding to the individual external electrodes 74. The oxide film 85 on the individual external electrodes 74 formed from the TiN electrodes 84 are then etched by a mixed has containing $CH_3$, thereby exposing the individual external electrodes 74 (or the TiN electrodes 84), while maintaining the insulating protection film 75 formed from the oxide film 85 on the electrodes 73.

In the above manner, a material that does not generate a product through the etching process is used for the etching mask. Thus, the reliability in electric connection between the individual external electrodes 74 and connectors can be increased.

The relationship between a material for the mask and a reaction product was checked, and the result shown in Table 1 were obtained. As shown in Table 1, no deposition was found, even when stainless steel was replaced with fluororesin lining.

TABLE 1

| Material | Reaction Product |
|---|---|
| SUS304 | found |
| Fluororesin lining | not found |
| Quartz | not found |
| Alumina | not found |

Figure 30A:
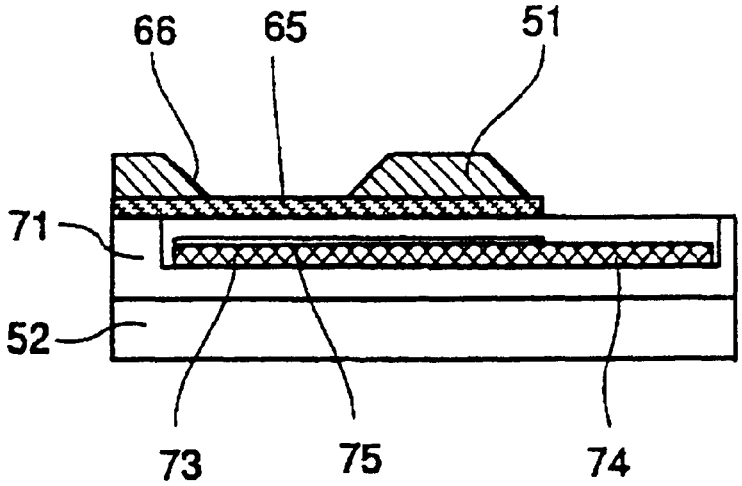
FIG. 30A is a sectional view of the ink jet head taken along the line Q—Q of FIG. 30C.
Figure 30B:
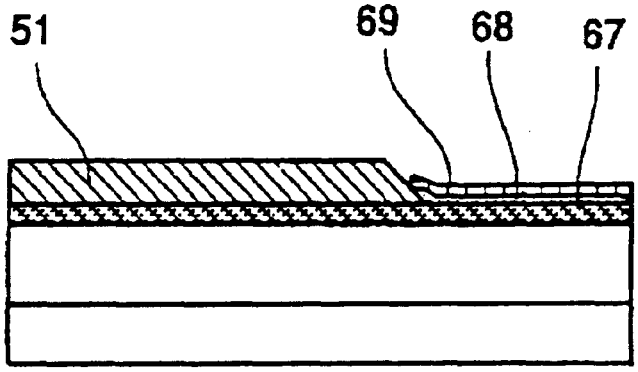
FIG. 30B is a sectional view of the ink jet head taken along the line R—R of FIG. 30C.
Figure 30C:
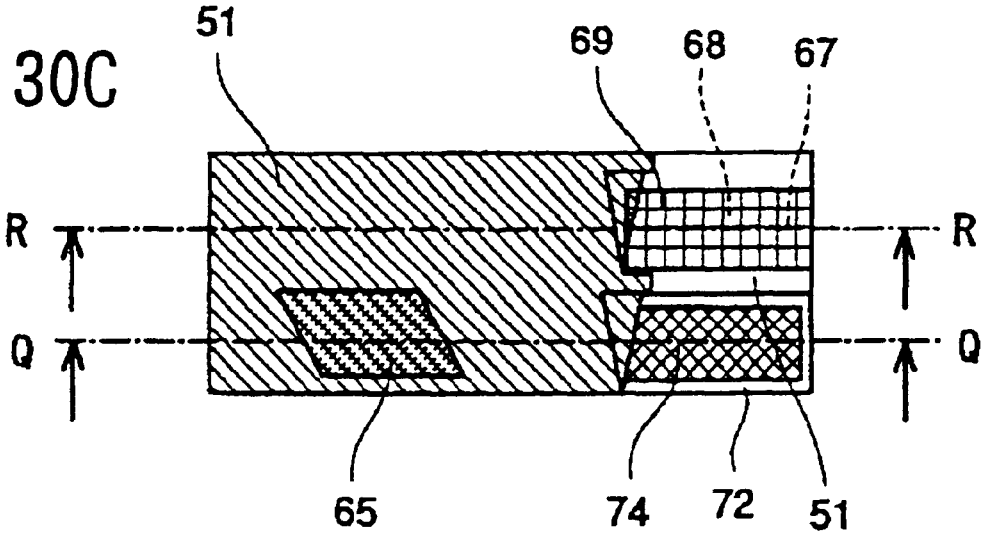
FIG. 30C is a plan view of the ink jet head.

The oxide film is removed in the above manner, thereby obtaining the head chips as shown in FIGS. 30A to 30C. The nozzle unit 53 is then bonded onto the diaphragm/liquid chamber substrate 51 by epoxy adhesive, and FPC is connected to the surface of the second metal layer 69 and the surfaces of the individual external electrodes 74 by means of heat pressure. Since the diaphragm external electrode 67 and the individual external electrodes 74 are aligned, and the vertical-direction distance between the diaphragm external electrode 67 and the individual external electrodes 74 is short, collective pressure bonding can be preformed without using a special-purpose connector.

In the foregoing embodiments, the diaphragms are located in parallel with the electrodes. However, it is possible to arrange the diaphragms not in parallel with the electrodes, and to form the gaps having different thicknesses or having curved surfaces.

The present invention is not limited to the specifically disclosed embodiments, but variations and modifications may be made without departing from the scope of the present invention.

The present invention is based on Japanese priority application No. 11-222444, filed on Aug. 5, 1999, the entire contents of which are hereby incorporated by reference.

What is claimed is:

1. An ink jet head comprising:

nozzle holes that discharge ink droplets;

discharging chambers that communicate with the nozzle holes;

diaphragms that form at least one wall surface of each of the discharging chambers;

electrodes that are adjacent to the diaphragms; and a diaphragm external electrode that is formed at a same height as the diaphragms;

wherein the diaphragms are deformed by electrostatic force generated between the diaphragms and the electrodes so as to discharge the ink droplets.

2. The ink jet head as claimed in claim 1, further comprising individual external electrodes disposed within 2 $\mu$m in height from the diaphragm external electrode.

3. The ink jet head as claimed in claim 1, further comprising individual external electrodes that are aligned with the diaphragm external electrode.

4. The ink jet head as claimed in claim 1, wherein:

the diaphragms and the diaphragm external electrode are formed on a first substrate;

the electrodes and the individual external electrodes are formed on a second substrate; and parts of the first substrate corresponding to the individual external electrodes on the second substrate are removed while the diaphragm external electrode is maintained.

5. The ink jet head as claimed in claim 1, wherein:

the diaphragms and the diaphragm external electrode are formed on a first substrate; and a metal layer is formed on the diaphragm external electrode.

6. The ink jet head as claimed in claim 5, wherein the metal layer on the diaphragm external electrode has a multi-layered structure.

7. The ink jet head as claimed in claim 6, wherein a layer of the metal layer in contact with the first substrate is made of a metal that can be in ohmic contact with silicon.

8. The ink jet head as claimed in claim 6, wherein the outermost layer of the metal layer is made of a metal that has resistance against an etching species based on halogen.

9. A method of producing an ink jet head, comprising the steps of:

bonding a first substrate having diaphragms and a diaphragm external electrode formed thereon, said diaphragm external electrode being formed at a same height as said diaphragms, to a second substrate having electrodes and individual external electrodes formed thereon, with a predetermined distance being left between each of the diaphragms and each corresponding one of the electrodes;

forming a contact portion having the same thickness as the diaphragms, the contact portion including at least a region on the first substrate corresponding to a region including the individual external electrodes on the second substrate and a part to become the diaphragm external electrode; and removing the region of the contact portion except the part to become the diaphragm external electrode.

10. The method as claimed in claim 9, wherein the bonding step is an anodic bonding step that includes the steps of:

forming a $SiO_2$-film gap spacer on the first substrate that is a monocrystal silicon substrate, or forming concave portions in the second substrate that is a glass substrate, so that the predetermined distance is maintained between each of the diaphragms and each corresponding one of the electrodes.

11. The method as claimed in claim 9, wherein the bonding step includes the steps of:

forming a $SiO_2$-film gap spacer in the first substrate that is a monocrystal silicon substrate and/or in the second substrate that is also a monocrystal silicon substrate; and bonding the first substrate and the second substrate directly to each other, so that the predetermined distance is maintained between each of the diaphragms and each corresponding one of the electrodes.

12. The method as claimed in claim 9, further comprising the step of prior to the removing step, forming a protection film having resistance to etching on the part to become the diaphragm external electrode.

13. The method as claimed in claim 12, wherein the relationships $(a/x)>1$ and $(a/y)<1$, are satisfied, wherein: x represents a short side of an opening of each of the diaphragms; y represents a short side of the contact portion; and a represents a thickness of the first substrate.

14. The method as claimed in claim 9, further comprising the step of prior to the removing step, forming a protection film having resistance to etching in the region other than the region to be removed from the first substrate by etching.

15. The method as claimed in claim 9, wherein when etching is performed on the first substrate, a part between the part to become the diaphragm external electrode and the adjacent individual external electrode is maintained.

16. The method as claimed in claim 15, where in the relationships, $(a/x)>1$, $(a/z)>1$, and $(a/y)<1$, are satisfied, wherein: x represents a short side of an opening of each of the diaphragms; y represents a short side of the contact portion; z represents a short side of the diaphragm external electrode; and a represents a thickness of the first substrate.

17. The method as claimed in claim 9, further comprising the steps of:

forming a p-type or n-type impurity layer on a part of each of the electrodes adjacent to each corresponding one of the diaphragms;

forming a heat-resistant film on the contact portion; and forming a connecting hole between the impurity layer and the heat resistant film.

18. The method as claimed in claim 9, wherein an etching mask made of a material that does not generate a product is used.

19. The method as claimed in claim 18, wherein the etching mask is made of quartz.

20. The method as claimed in claim 18, wherein the etching mask is made of alumina.

21. A method of producing an ink jet head, comprising:

bonding a silicon wafer that is a first substrate having diaphragms and a diaphragm external electrode formed thereon, said diaphragm external electrode being formed at a same height as said diaphragms, to a second substrate having electrodes and individual electrodes formed theron;

performing etching on the first substrate, leaving a contact portion including a region corresponding to the individual electrodes on the second substrate and a part to become the diaphragm external electrode;

cutting the silicon wafer into head chips; and removing the region corresponding to the individual electrodes from the contact portion.

22. The method as claimed in claim 21, wherein when the diaphragm external electrode is formed, a metal layer having a low etching rate compared with silicon is formed on the part to become the diaphragm external electrode.

23. The method as claimed in claim 21, wherein an etching mask made of a material that does not generate a product is used.

24. The method as claimed in claim 23, wherein the etching mask is made of quartz.

25. The method as claimed in claim 23, wherein the etching mask is made of alumina.

* * * * *